US007377824B2

(12) United States Patent
Mizutani et al.

(10) Patent No.: US 7,377,824 B2
(45) Date of Patent: May 27, 2008

(54) CONNECTOR AND CONNECTOR ASSEMBLY

(75) Inventors: Masaki Mizutani, Yokkaichi (JP); Tomoyoshi Fukaya, Yokkaichi (JP); Kazuaki Takeda, Yokkaichi (JP); Tsutomu Tanaka, Yokkaichi (JP)

(73) Assignee: Sumitomo Wiring Systems, Ltd (JP)

( * ) Notice: Subject to any disclaimer, the term of this patent is extended or adjusted under 35 U.S.C. 154(b) by 0 days.

(21) Appl. No.: 11/642,507

(22) Filed: Dec. 20, 2006

(65) Prior Publication Data

US 2007/0141921 A1 Jun. 21, 2007

(30) Foreign Application Priority Data

Dec. 20, 2005 (JP) ..... 2005-366725
Jan. 10, 2006 (JP) ..... 2006-002425

(51) Int. Cl.
*H01R 13/514* (2006.01)

(52) U.S. Cl. ..... 439/752

(58) Field of Classification Search ..... 439/752, 439/701, 595, 596, 744, 912, 594, 354, 507, 439/358, 852, 748
See application file for complete search history.

(56) References Cited

U.S. PATENT DOCUMENTS 5,730,627 A * 3/1998 Okabe ..... 439/752
6,146,200 A 11/2000 Ito et al.
6,328,614 B1 * 12/2001 Osawa ..... 439/752
6,375,504 B1 4/2002 Ito et al.
6,527,579 B2 * 3/2003 Sato et al. ..... 439/382
2002/0076990 A1 6/2002 Fujita
2004/0235365 A1 * 11/2004 Fujita ..... 439/752
2005/0233652 A1 10/2005 Tsuji

FOREIGN PATENT DOCUMENTS

EP 0 963 008 A2 12/1999
JP 2001-332332 11/2001

* cited by examiner

*Primary Examiner*—Edwin A. Leon
(74) *Attorney, Agent, or Firm*—Gerald E. Hespos; Anthony J. Casella

(57) ABSTRACT

An auxiliary connector (14) has cavities (35) for receiving terminal fittings (13) and resilient locks (40) that deform in a deforming direction (DD) that extends along an arranging direction of the cavities (35). The locks (40) are configured for holding the terminal fittings (13) in the cavities (35). A retainer (39) is formed integrally with the auxiliary connector (14) via a hinge (75) at an opening edge of a retainer accommodating hole (73) in a side surface of the auxiliary connector (14) facing a direction intersecting the deforming direction (DD) of locks (40). The retainer (39) has locking protrusions (78) for redundantly locking the terminal fittings (13) in the cavities (35). The locking protrusions (78) of the retainer (39) are arranged at substantially the same positions for all cavities (35).

9 Claims, 29 Drawing Sheets

CONNECTOR AND CONNECTOR ASSEMBLY

BACKGROUND OF THE INVENTION

1. Field of the Invention

The invention relates to a connector.

2. Description of the Related Art

Japanese Unexamined Patent Publication No. 2001-332332 discloses a connector that has a housing formed with cavities for receiving terminal fittings. A lock is formed in each cavity for resiliently locking and retaining the terminal fitting. A retainer accommodating hole opens in an outer wall of the housing that is opposite the wall where the locks are formed. A retainer can be accommodated into the retainer accommodating hole to achieve redundant locking of the terminal fittings. The retainer is joined integrally to the housing by a hinge at the opening edge of the retainer accommodating hole, and can swing with the hinge as a support. Thus, the number of parts can be reduced as compared to the case where the retainer is formed separately. The retainer is accommodated into the retainer accommodating hole in the deforming direction of the locks.

The cavities of a connector often are arranged in the deforming direction of locks, and the above-described retainer that is swung about the hinge can be used with such a connector. However, the retainer then is advanced into the retainer accommodating hole in the deforming direction of the locks and in the arranged direction of the cavities.

The above-described retainer that is swung around the hinge for advancement into the retainer accommodating hole has a substantially fan-shape with a radius equal to a distance between the opening edge of the retainer accommodating hole at a side where the hinge is formed and the opening edge at a side opposite to the side that has the hinge-formed side when viewed in a direction intersecting the deforming direction of the locks to prevent an end of the retainer from getting caught by the opening edge of the retainer accommodating hole.

Thus, the positions of the retainer in the respective cavities gradually change at each stage of the cavities due to the substantially fan-shape of the retainer. As a result, engaging portions of the terminal fittings with the retainer must be at different positions depending on the stage at which the terminal fittings are arranged. This is not practical.

The present invention was developed in view of the above problem and an object thereof is to provide a connector and corresponding connector assembly having an improved construction in which cavities are arranged in the resiliently deforming direction of locking portions.

SUMMARY OF THE INVENTION

The invention relates to a connector that has a housing formed with cavities for receiving terminal fittings. Resiliently deformable locks are formed in the cavities and are engageable with the terminal fittings. The cavities are arranged in the deforming direction of the locks. A retainer accommodating hole extends into a side of the housing in a direction intersecting the resiliently deforming direction of the lock and has a depth to communicate with the respective cavities. A retainer can be accommodated into the retainer accommodating hole and includes locking protrusions engageable with the terminal fittings.

The cavities are arranged in the deforming direction of the locks. However, the retainer is mounted into the housing in the direction intersecting the deforming direction of the locks. Thus, the locking protrusions of the retainer are arranged at substantially the same positions in the cavities at the respective stages with the retainer accommodated in the retainer accommodating hole. As a result, positions of the terminal fittings engaged with the retainer can be aligned for the respective terminal fittings accommodated in the cavities at the respective stages.

The retainer preferably is formed integrally or unitarily with the connector housing via at least one hinge at the opening edge of the retainer accommodating hole. The integrally or unitarily formed housing and retainer can be provided at lower costs while maintaining the overall operability.

Each terminal fitting preferably has a tube with an engageable portion for engaging the locking protrusion of the retainer. Each locking protrusion of the retainer is engaged with the engageable portion in the direction intersecting the deforming direction of the lock. Thus, displacement of the terminal fittings along the deforming direction of locks is prevented by the locks and displacement of the terminal fittings along the direction intersecting the deforming direction of the locks are prevented by the retainer. The postures of the terminal fittings are stabilized by preventing displacements in two different directions.

The retainer inadvertently may be accommodated in the retainer accommodating hole before all the terminal fittings are inserted into the cavities. An attempt then may be made to insert a terminal fitting into the cavity. A terminal fitting that is pushed against a prior art retainer may be damaged by the pushing forces. Accordingly, an inclined surface preferably is provided on an inner surface of the retainer of the subject invention. The inclined surface is disposed to achieve sliding contact with the terminal fitting. Thus, the terminal fitting will push the retainer out of the cavity if the retainer is in the retainer accommodating hole when the terminal fitting is inserted into the cavity. Accordingly, the terminal fitting is not likely to be damaged by pushing forces against the retainer.

The connector preferably has a frame formed with at least one accommodating chamber for receiving the housing. The housing and the frame can be connected with a mating connector.

The connector may include at least one busbar. Each busbar has at least one tab. The accommodating chambers of the frame preferably are arranged in a direction intersecting the thickness direction of the busbars when the frame and the mating connector are connected properly.

Resilient contacts preferably are formed in the tubes of the terminal fittings accommodated in the connector and are capable of resiliently touching the tabs of the busbar. The resilient contacts touch plate surfaces of the tabs. Accordingly, the busbar can short specified terminal fittings in the connector accommodated in the frame.

The tabs are formed by being cut at the opposite ends thereof, and the cut surfaces are not necessarily smooth because a large force was applied for the cutting operation. Thus, the connection stability of the tabs and the resilient contacts may be reduced if the cut surfaces are brought into contact with the resilient contacts. In view of the above, the plate surfaces of the tabs facing in the thickness direction of the tabs are brought into contact with the resilient contacts to make electrical connection between the tabs and the resilient contacts more secure.

An interacting portion preferably is formed near the front end of a side surface of the connector with respect to an inserting direction of the connector into the accommodating chamber and projects out in the resiliently deforming direction of the lock. The interacting portion is engageable with a housing lock formed on the frame.

At least one finger placing portion preferably is formed near the rear end of the side surface of the connector where the interacting portion is formed, but at a position deviated from the interacting portion in a direction intersecting the inserting direction of the connector into the accommodating chamber. The finger placing portion preferably is rearward of a partition wall that separates the accommodating chambers when the connector is inserted properly in the accommodating chamber. The finger placing portion enables an operator to separate the connector from the frame efficiently by holding the finger placing portion by the fingers.

The deviation of the finger placing portion from the interacting portion in the direction intersecting the inserting direction of the connector into the accommodating chamber enables use of a mold that can be removed backward with respect to the inserting direction of the connector. Thus, a sliding mold is not needed, and production cost can be reduced.

The deviation of the finger placing portion from the interacting portion in the direction intersecting the inserting direction of the connector into the accommodating chamber could enlarge the connector in the direction intersecting the inserting direction of the connector into the accommodating chamber. However, the finger placing portion is located behind the partition wall that separates the accommodating chambers when the connector is inserted in the accommodating chamber. Thus, an area behind the partition wall conventionally has been dead space. Since the finger placing portion is arranged in this area, the entire connector including the frame need not be enlarged in the direction intersecting the inserting direction of the connector into the accommodating chamber.

The invention also relates to a connector assembly comprising the above described connector and a mating connector connectable therewith. At least one lock is provided at a side wall of the mating housing and is located at an outer side in a properly connected state of the housings. The lock is resiliently deformable substantially outward in the thickness direction of the side wall. At least one interlocking portion is formed on the housing and is engageable with the lock portion to hold the two housings.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
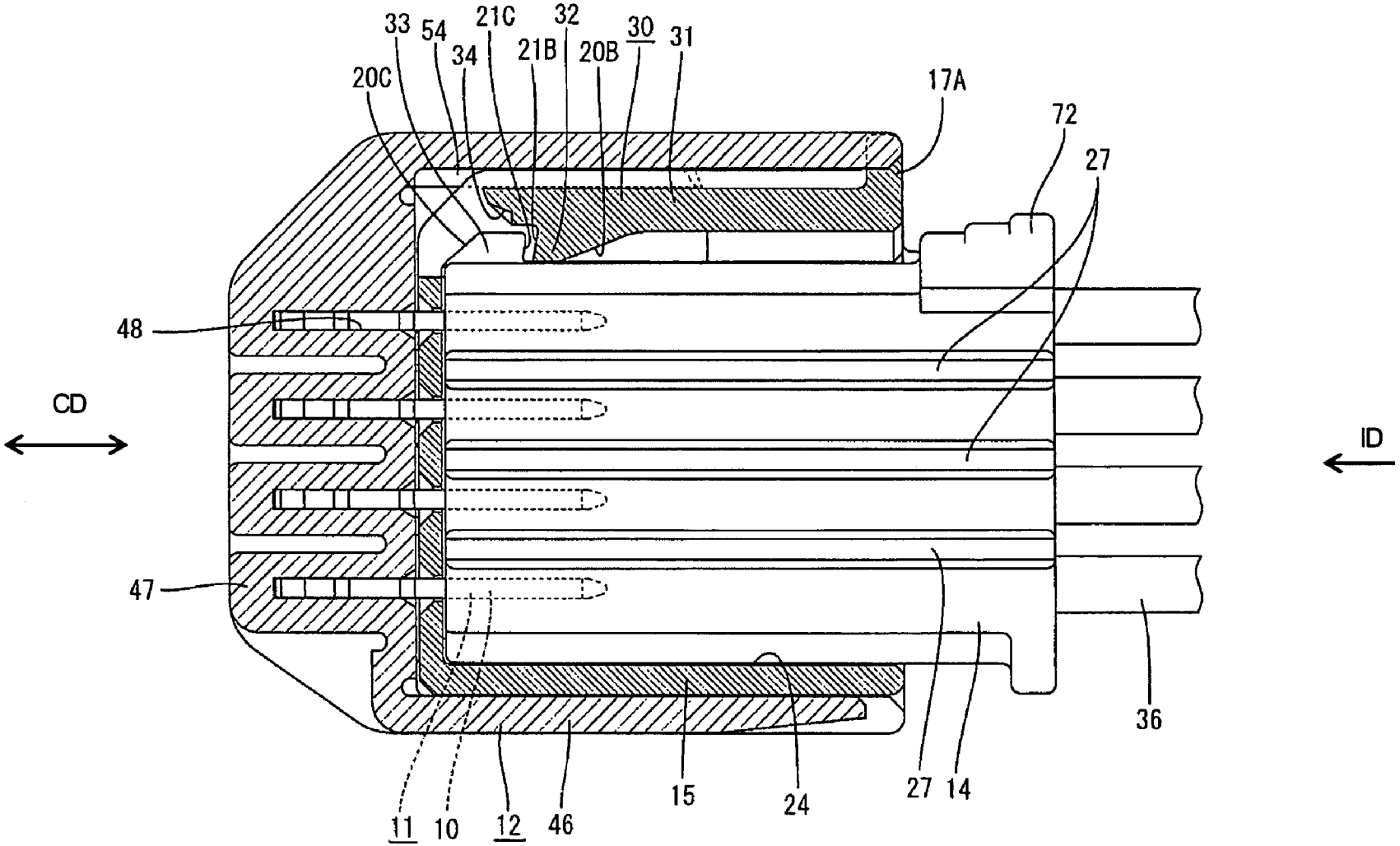
FIG. 1 is a vertical section of a connector according to the invention.
Figure 2:
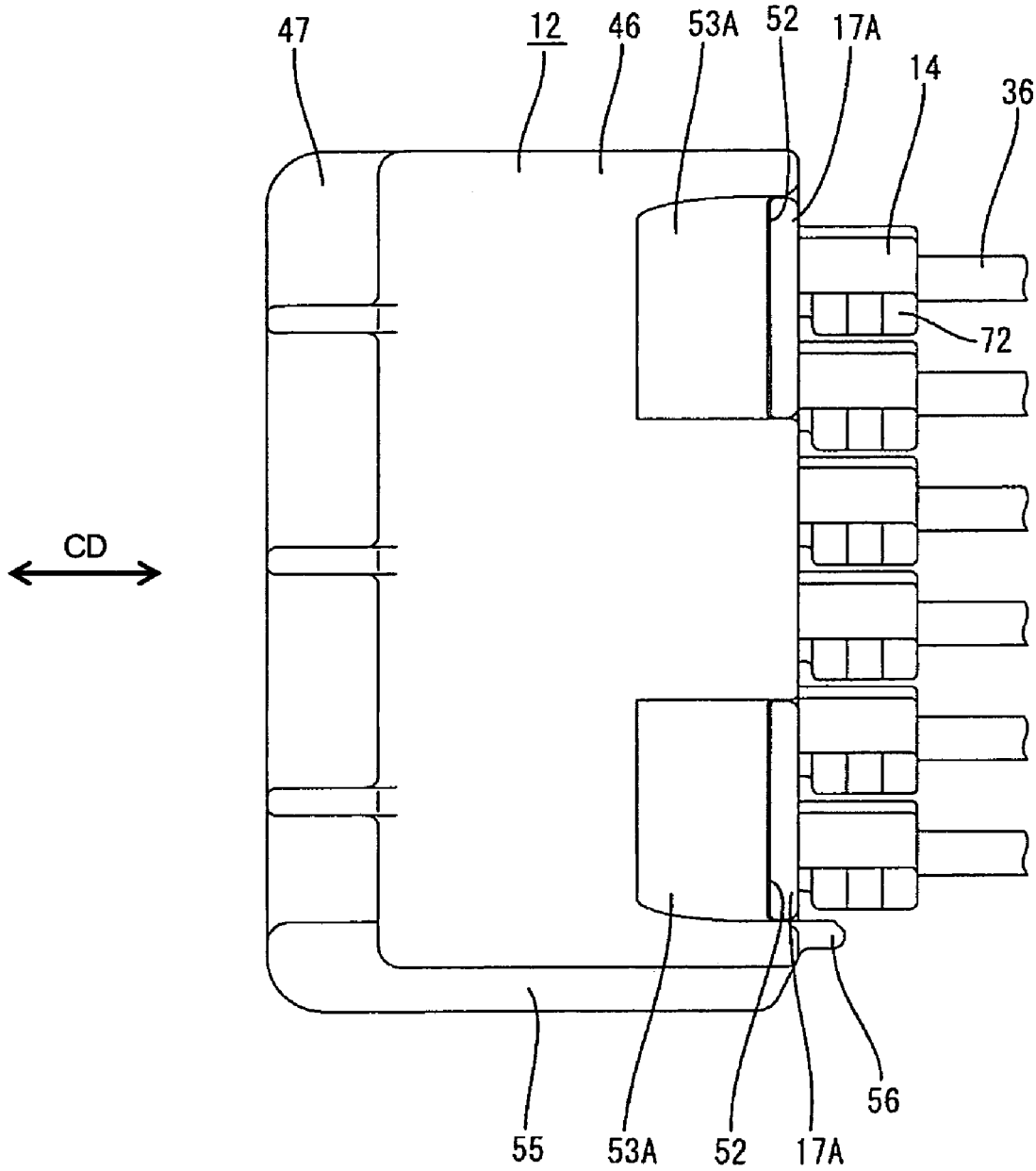
FIG. 2 is a plan view of the connector.

A preferred embodiment of a connector according to the invention is described with reference to FIGS. 1 to 30. The connector is a divided connector and has male tabs 10 formed on busbars 11 that are accommodated in a male housing 12. The connector also has female terminal fittings 13 accommodated in auxiliary connectors 14 mounted in a female frame 15. The male housing 12 is to be mounted on an unillustrated fixed body by a bracket 16 to be provided on the fixed body. In the following description, connecting directions CD of the male housing 12 and the female frame 15 are referred to as forward directions and reference is made to FIG. 1 concerning vertical direction.

Figure 16:
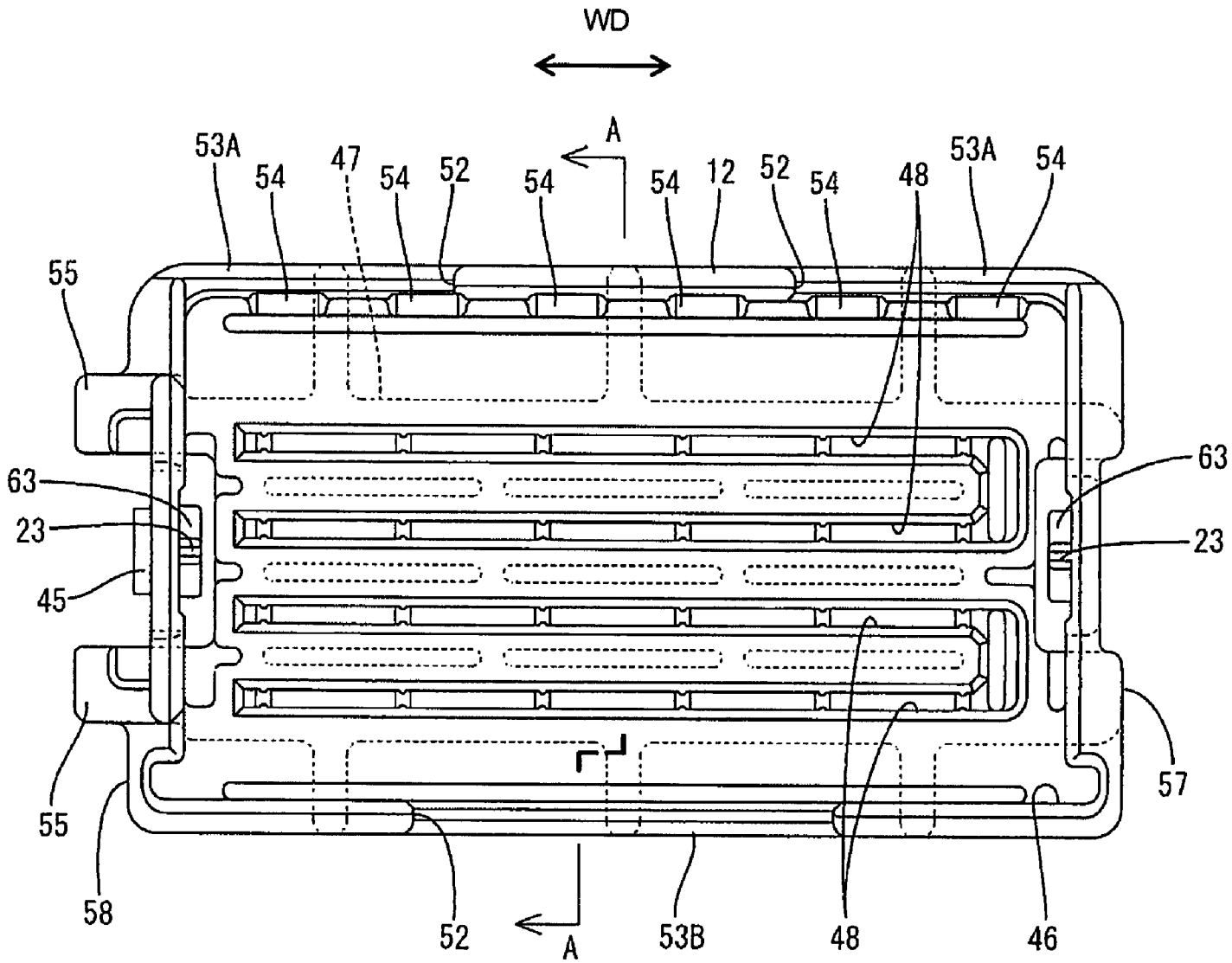
FIG. 16 is a front view of a male housing.
Figure 17:
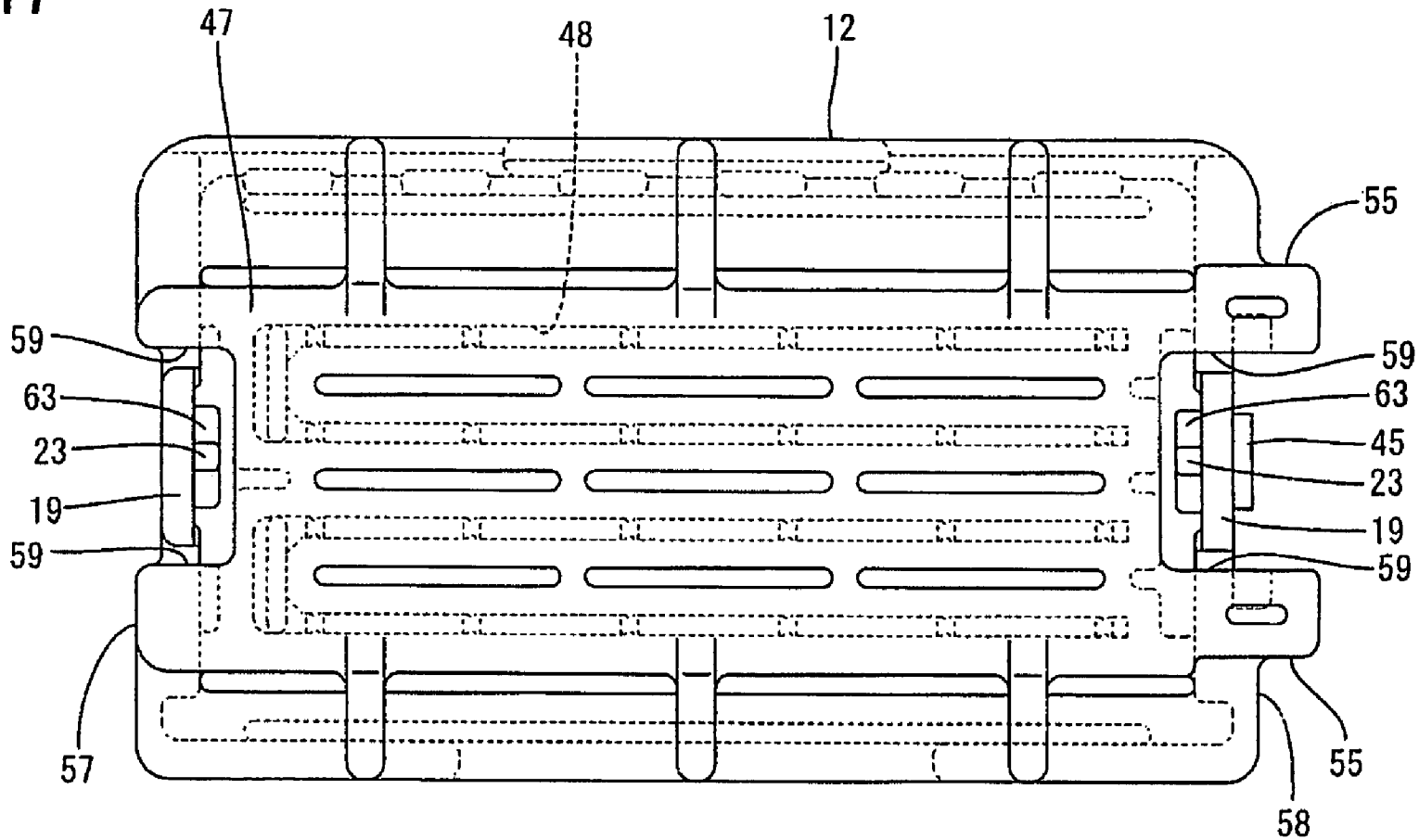
FIG. 17 is a rear view of the male housing.

The male housing 12 is made e.g. of a synthetic resin and includes a receptacle 46 with an open front and a busbar holding portion 47 behind the receptacle 46, as shown in FIG. 1. Busbar holding grooves 48 are formed one above another in a back surface of the receptacle 46 of the busbar holding portion 47 exposed at the back of the receptacle 46 and extend in the width direction WD, as shown in FIG. 16.

Figure 21:
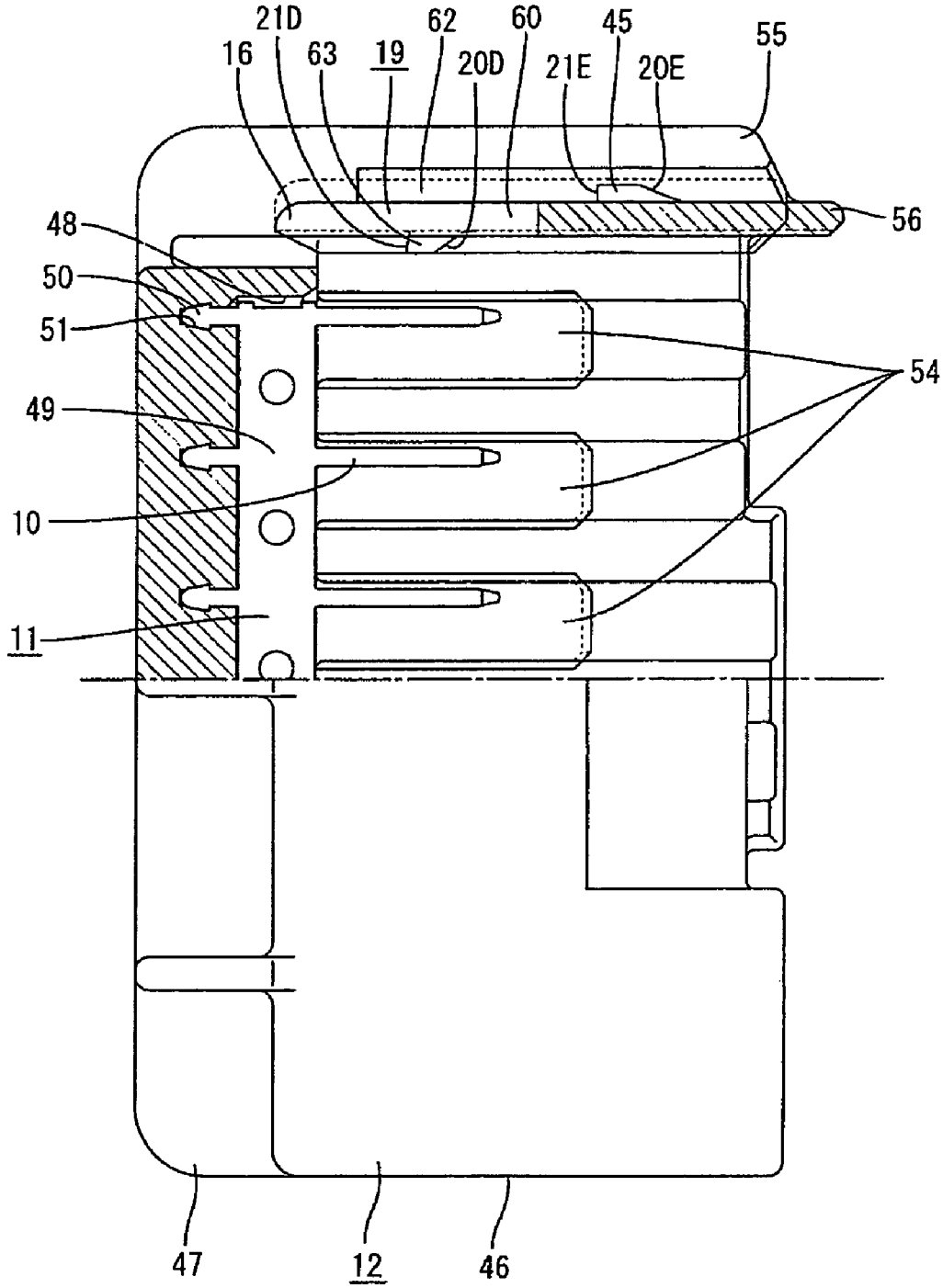
FIG. 21 is a bottom view of the male housing showing essential portions including a lock portion and partial connection detecting ribs in section.

Each busbar 11 is formed by punching, cutting or stamping a conductive metallic plate and includes male tabs 10, as shown in FIG. 21. A coupling 49 couples the male tabs 10 and fixing portions 50 project from a side of the coupling 49 opposite the male tabs 10. The coupling 49 is accommodated in the busbar holding groove 48 and the fixing portions 50 are pressed into fixing holes 51 in the busbar holding groove 48 to hold each busbar 11 in the corresponding busbar holding groove 48. The male tabs 10 project into the receptacle 46 when the coupling 49 is fixed in the busbar holding groove 48. With the busbars 11 fixed in the busbar holding grooves 48, the respective busbars 11 are arranged in the thickness direction thereof.

Figure 3:
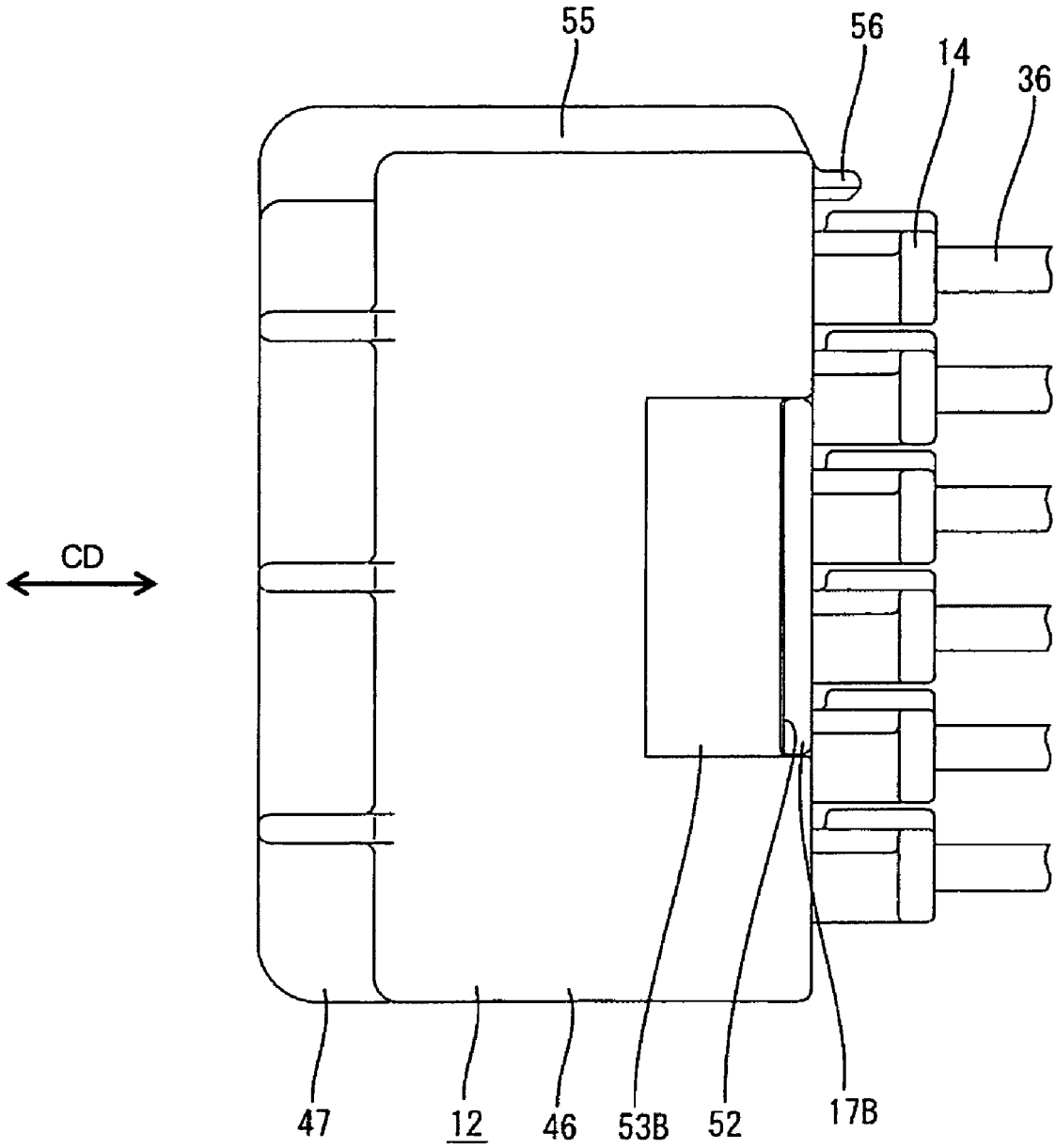
FIG. 3 is a bottom view of the connector.
Figure 18:
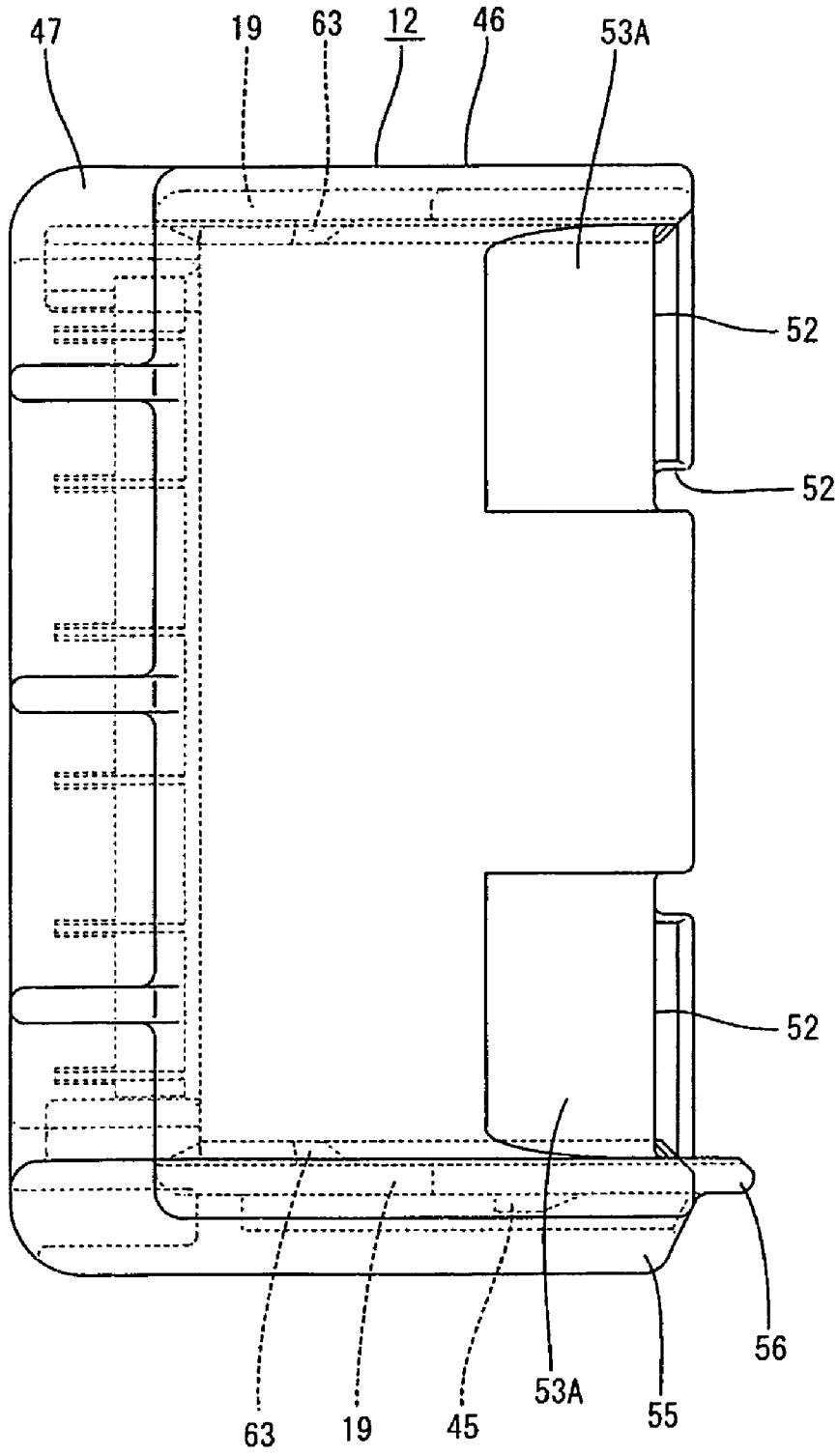
FIG. 18 is a plan view of the male housing.

Lateral ends of the front edge of the ceiling wall of the receptacle 46 are recessed to form notches 52, as shown in FIG. 18. A dimension of each notch 52 in forward and backward directions FBD substantially equals the thickness of the finger placing portions 17A of the female frame 15. As shown in FIG. 3, finger placing slants 53A slope out and up toward the back in the outer surface of the bottom wall of the receptacle 46 to extend from the notches 52. Upper ends of the finger placing portions 17A project from the front edges of the finger placing slants 53A when the male housing 12 and the female frame 15 are connected properly, thereby making it easier for an operator to place his fingers on the finger placing portion 17A.

Figure 4:
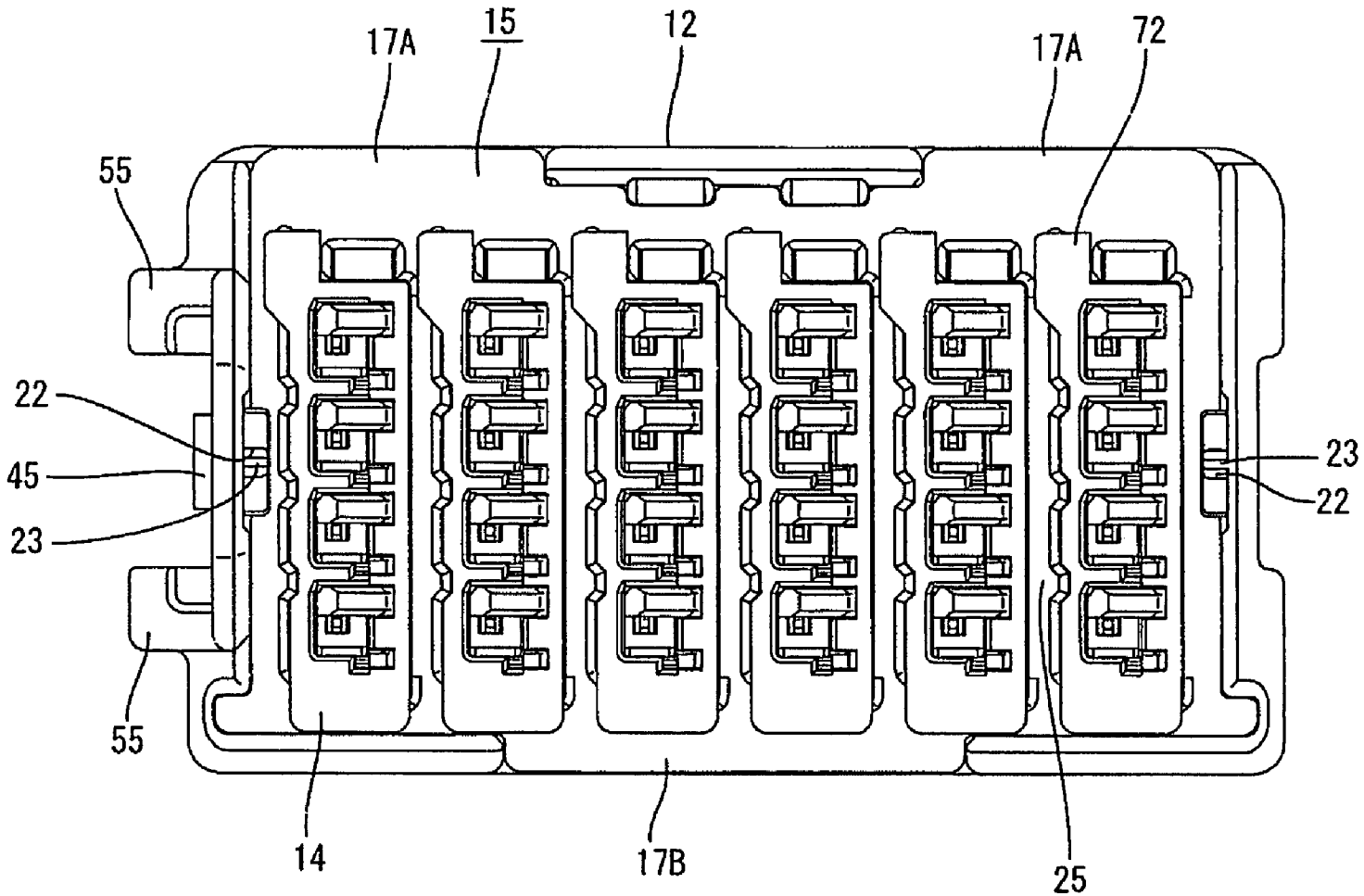
FIG. 4 is a rear view of the connector without wires and female terminal fittings.

As shown in FIG. 1, the rear end surface of the female frame 15 and the front end surface of the male housing 12 are substantially flush with each other when the female frame 15 and the male housing 12 are connected properly. Further, as shown in FIG. 4, the upper ends of the finger placing portions 17A of the female frame 15 and the bottom end of the finger placing portion 17B are substantially flush with the respective upper and bottom surfaces of the male housing 12 when the female frame 15 and the male housing 12 are connected properly.

Figure 22:
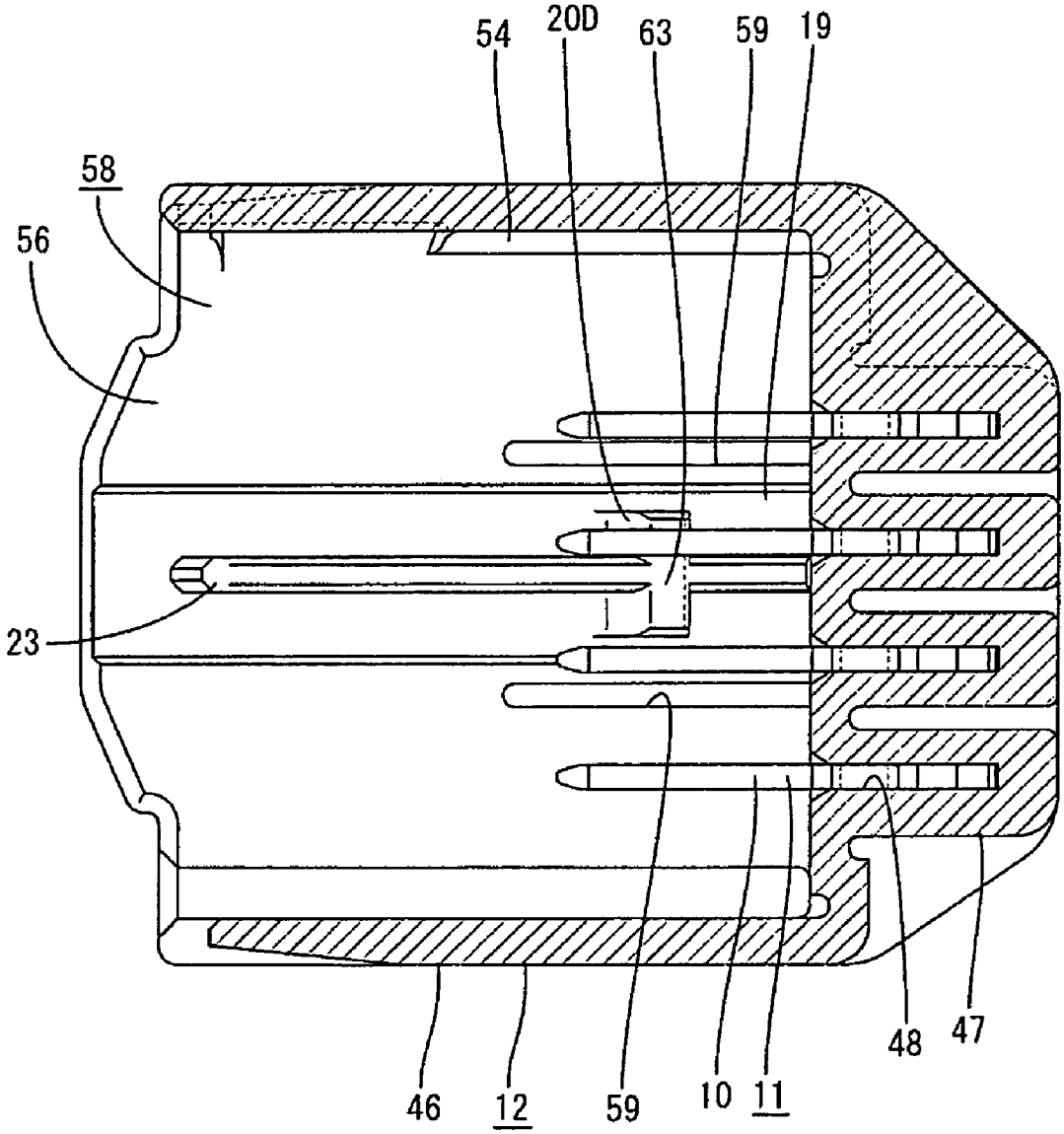
FIG. 22 is a section along A-A of FIG. 16.
Figure 23:
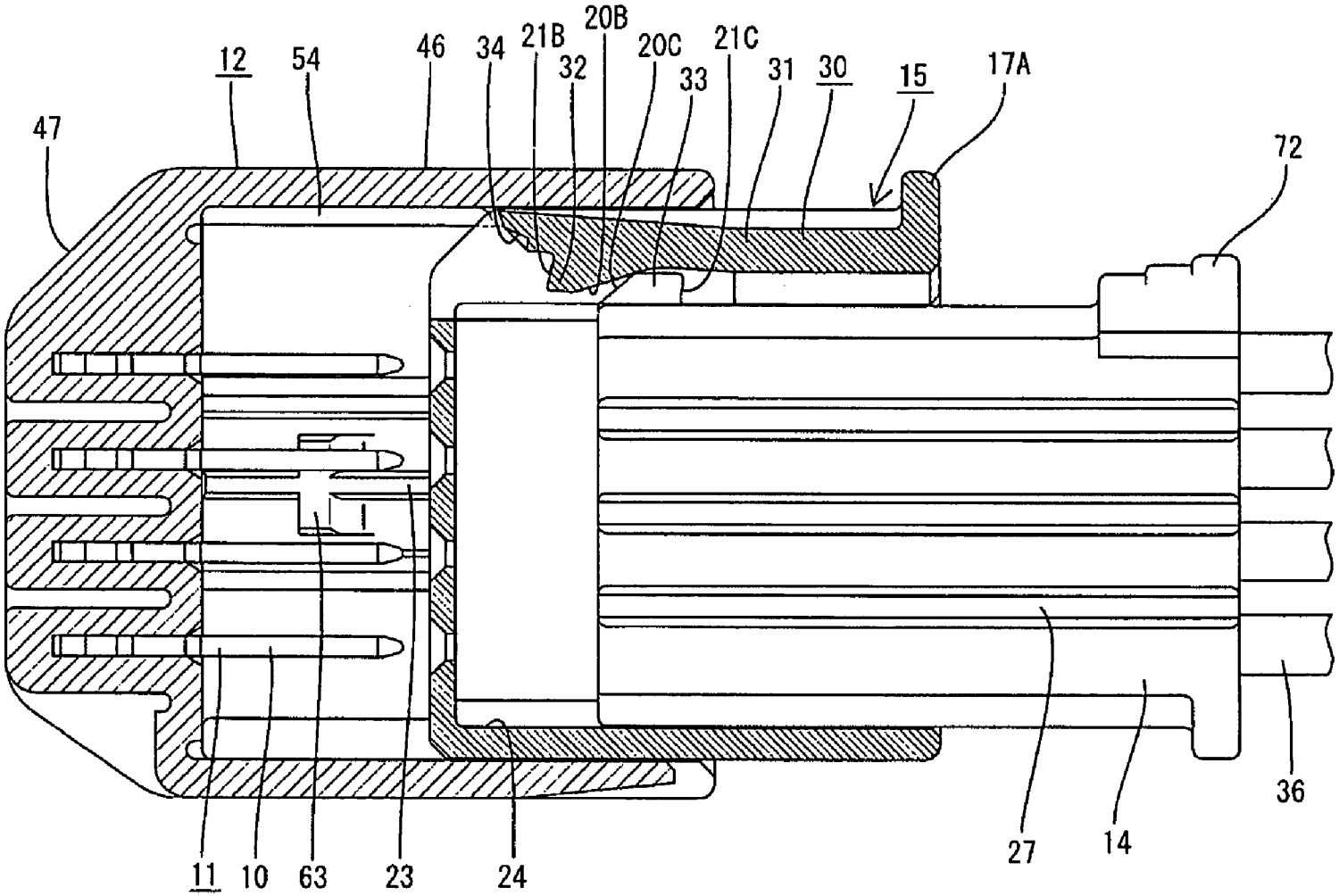
FIG. 23 is a side view in section showing a state where the partial connection detecting rib is in contact with a housing locking portion.

As shown in FIGS. 21 and 22, partial connection detecting ribs 54 project down from the inner surface of the ceiling of the receptacle 46 and extend forward from the rear end of the ceiling wall to a position retracted slightly back from the front edge of the ceiling wall. The front ends of the partial connection detecting ribs 54 have a downward inclination toward the front. As shown in FIG. 23, the frame side lock 30 of the female frame 15 remains deformed up and out without being resiliently restored if the auxiliary connector 14 is left insufficiently fit into the female frame 15. An attempt could be made to fit the female frame 15 into the male housing 12 in this state. However, the front edge of the frame side lock 30 contacts the front edge of the partial connection detecting rib 54 that projects down and in from the ceiling wall of the receptacle 46 to hinder further insertion of the auxiliary connector 14. In this way, partial connection of the auxiliary connector 14 is detected. Further, the partial connection detecting ribs 54 reinforce the ceiling of the receptacle 46.

A bracket guide 56 bulges forward (rightward in FIG. 19) from the front edge of a lateral wall 58 of the receptacle 46 and functions to guide the bracket 16 to the guide rails 55.

Collision preventing ribs 23 extend in forward and backward directions FBD along intermediate positions of the inner surfaces of right and left walls 57, 58 of the receptacle 46, as shown in FIG. 16. The collision preventing ribs 23 fit in the guiding grooves 22 in the female frame 15 and prevent the female frame 15 from entering the receptacle 46 in a vertically inclined state that could cause the front end of the female frame 15 to contact the male tabs 10. Front edges of the collision preventing ribs 23 are inclined to fit easily into the guiding grooves 22. The collision preventing rib 23 on the right wall 57 in FIG. 16 extends back from the front edge of the right wall 57. However, the collision preventing rib 23 on the left wall 58 extends back from a position retracted from the front edge of the left wall 58 and substantially aligns with the front end of the collision preventing rib 23 of the right wall 57, as shown in FIG. 22. Thus, the female frame 15 cannot fit into the receptacle 46 in an inclined posture with respect to the width direction WD where one side of the female frame 15 precedes the other, thereby preventing the front end of the female frame 15 from contacting the male tabs 10.

Figure 19:
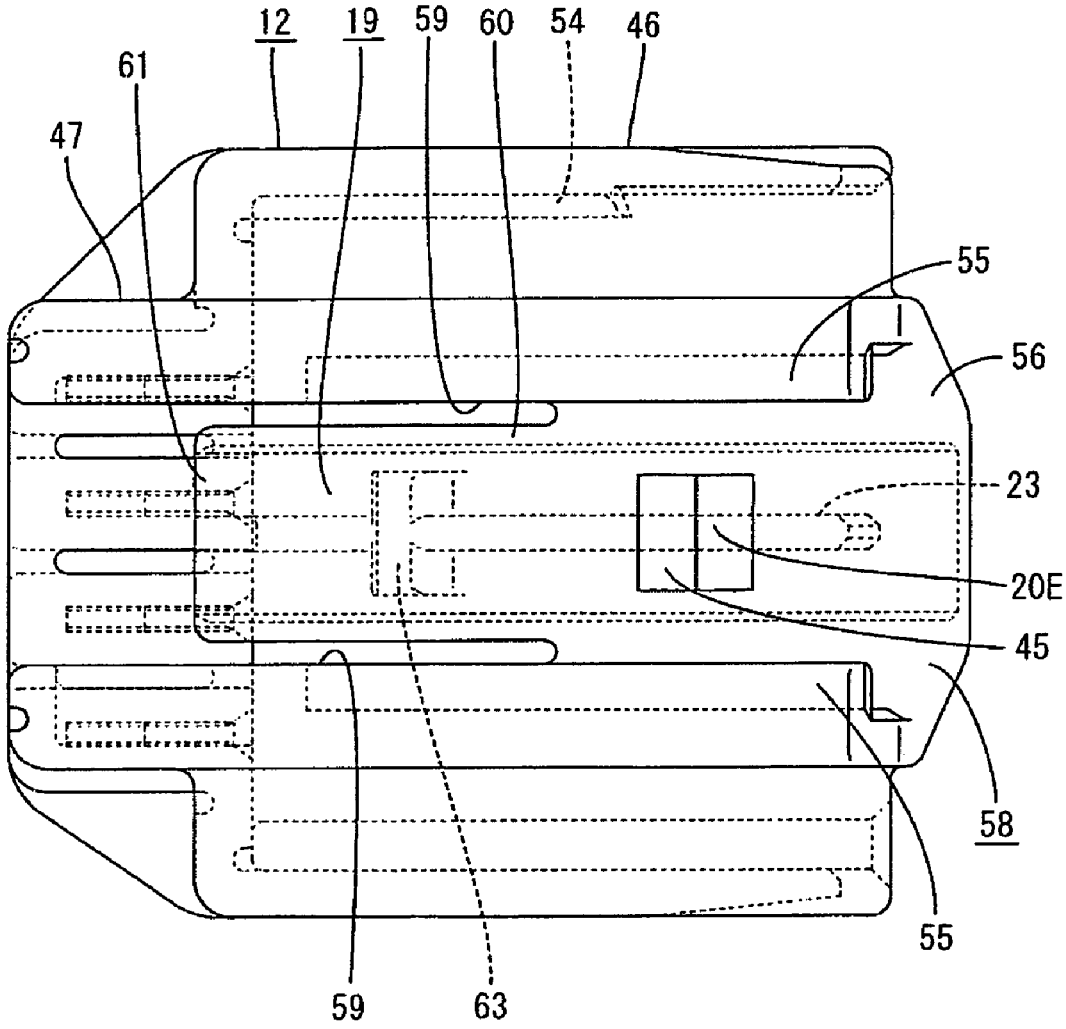
FIG. 19 is a left side view of the male housing.
Figure 20:
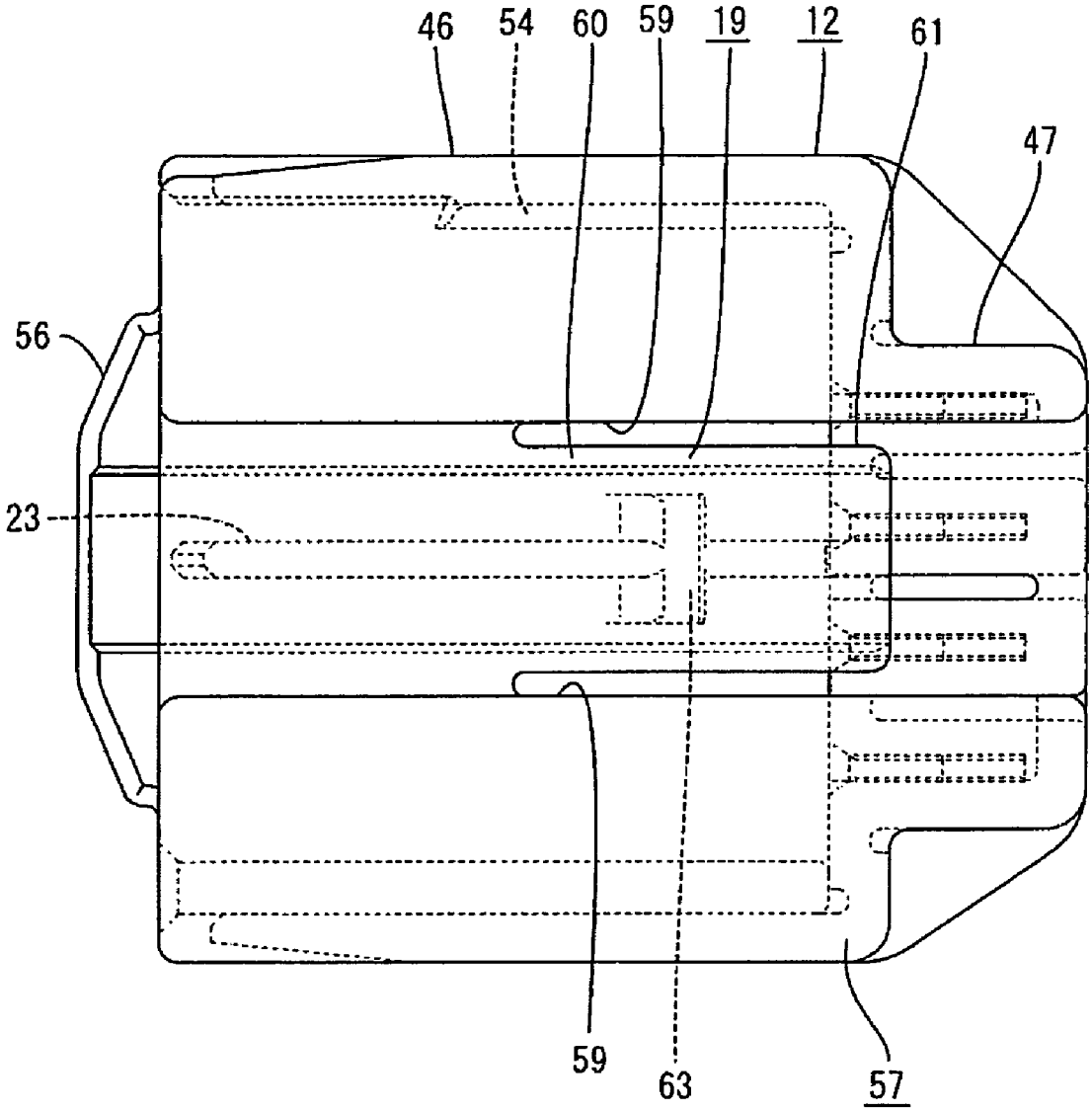
FIG. 20 is a right side view of the male housing.

As shown in FIGS. 19 and 20, two vertically spaced slits 59 are formed in intermediate positions of each of the right and left walls 57, 58 of the receptacle 46 and extend along the forward and backward directions FBD from the rear of the respective right and left walls 57, 58 to an intermediate position. A lock 19 is defined between the upper and lower slits 59 and is resiliently deformable out in the thickness direction of each of the respective walls 57, 58. The locks 19 engage the corresponding interlocking portion 18 of the female frame 15. The lock 19 in the right wall 57 extends back (right in FIG. 20) from a base end 60 to a free end 61. Further, the lock 19 in the left wall 58 extends back (left in FIG. 19) from a base end 60 to a free end 61 along an inserting direction ID of the bracket 16 into a clearance between the guide rails 55. Deformation areas 62 for the locks 19 are defined in spaces outside the locks 19 in the thickness direction of the right and left walls 57, 58 (space above the lock 19 in FIG. 5). A lock projection 63 projects in from the inner surface of each lock 19. An inclined surface 20D is defined at the front (right in FIG. 5) of the lock projection 63 so that the lock projection 63 can easily move onto the interlocking portion 18 of the female frame 15. A locking surface 21D is formed at the rear (left in FIG. 5) of the lock projection 63 and inclines slightly back towards its projecting end.

As shown in FIG. 22, the collision preventing ribs 23 extend on the inner surfaces of the locks 19 and reinforce the locks 19. The forcible collision preventing ribs 23 cross the lock projections 63 in forward and backward directions FBD at intermediate positions.

As shown in FIG. 19, two guide rails 55 project out from the outer surface of the left wall 58 of the receptacle 46 at positions above and below the lock 19. The guide rails 55 extend in the forward and backward directions FBD from positions near the front end of the left wall 58 to positions before the rear edge of the lock 19. As shown in FIG. 16, the guide rails 55 have substantially L-shaped cross sections when viewed from the front, and the bracket 16 can be inserted in the inserting direction ID into an area between the outer surface of the left wall 58 and surfaces of the guide rails 55 facing the left wall 58. The bracket 16 is stopped at a front end position in the inserting direction ID by the contact of the leading end of the bracket 16 with the back walls of the guide rails 55 (see FIG. 6).

Figure 5:
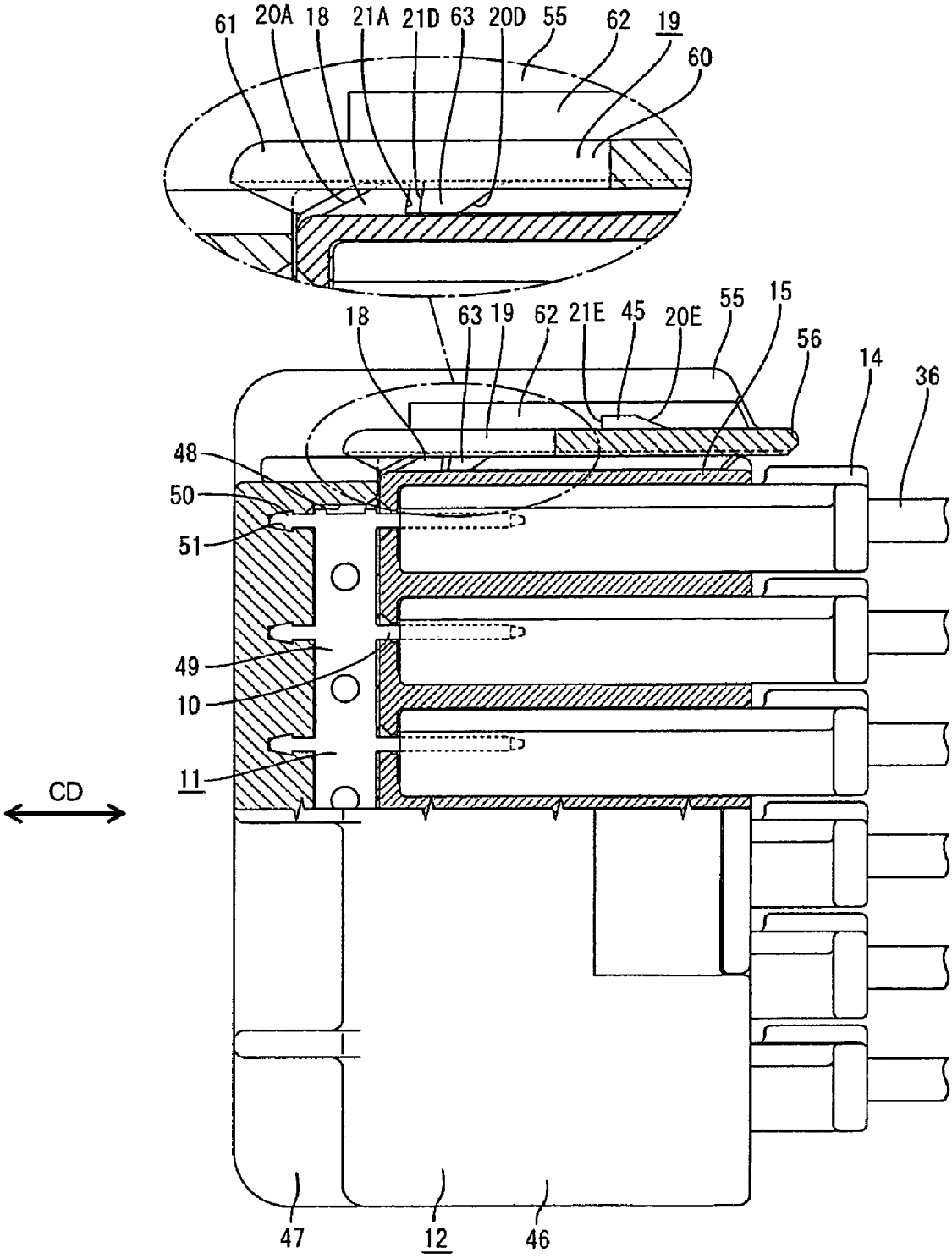
FIG. 5 is a bottom view partly in section of the connector.

As shown in FIG. 19, the engaging portion 45 projects out from the outer surface of the left wall 58 of the receptacle 46 (see FIG. 16) in an area between the upper and lower guide rails 55 and before (to the right in FIG. 19) the lock 19. The engaging portion 45 engages the locking section 44 of the bracket 16 for fixing the bracket 16 and the male housing 12 together. As shown in FIG. 5, an inclined surface 20E is formed at the front (right in FIG. 5) of the engaging portion 45 so that the bracket 16 can easily move thereon. However, a locking surface 21E is formed at the rear of the engaging portion 45 and is upright with respect to the outer surface of the left wall 42. The locking surface 21E of the engaging portion 45 contacts the opening edge of the locking section 44 of the bracket 16 from the front to retain the bracket 16.

As shown in FIG. 16, the height of the guide rails 55 from the outer surface of the left wall 58 exceeds the heights of the lock 19 and the engaging portion 45. Thus, the guide rails 55 protect the lock 19 and the engaging portion 45 from collision with external matter.

Figure 6:
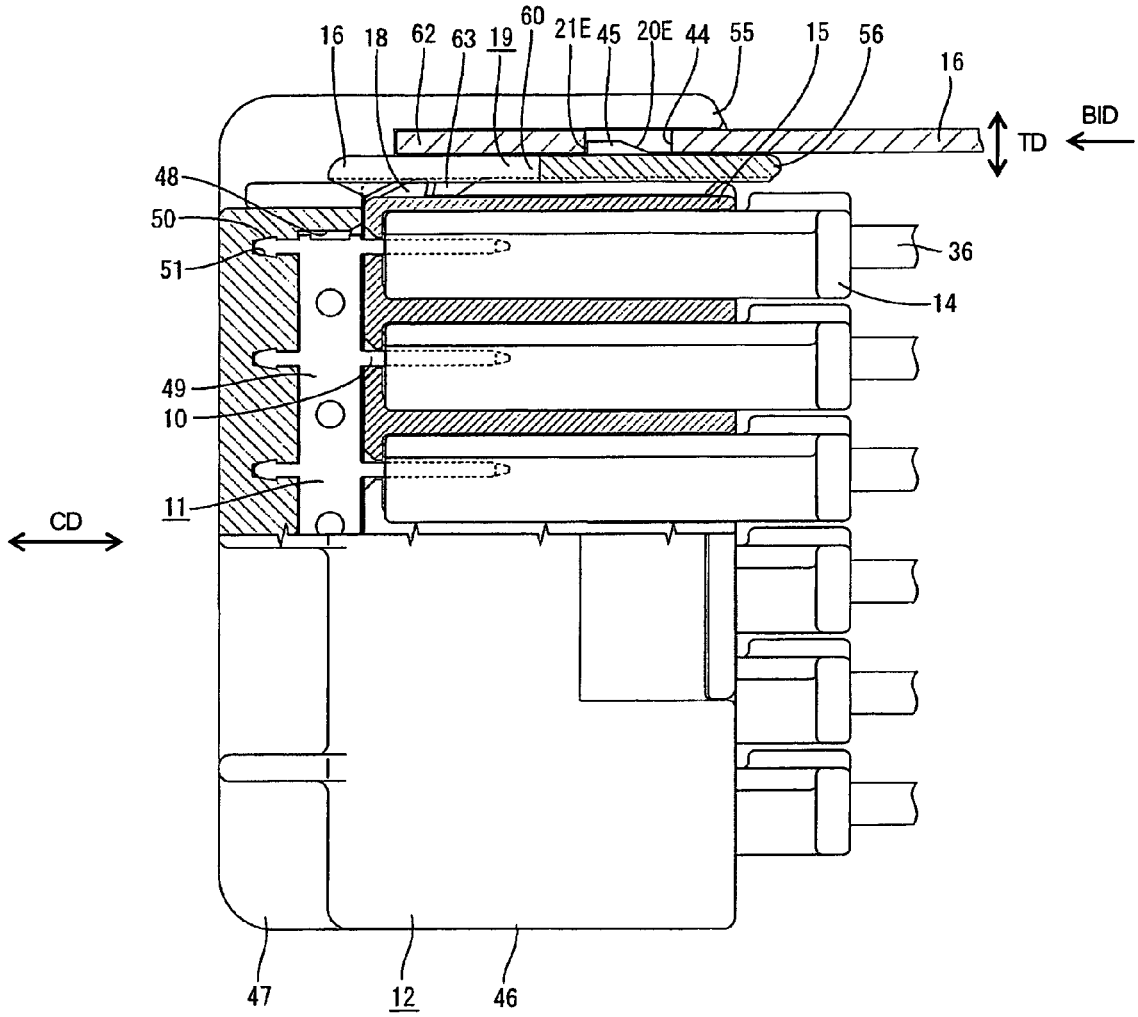
FIG. 6 is a bottom view partly in section of the connector assembled with a bracket.

As shown in FIG. 6, the bracket 16 is dimensioned in forward and backward directions FBD to be in the deformation area 62 of the lock 19 when the bracket 16 is inserted between the guide rails 55 and the locking section 44 of the bracket 16 engages the engaging portion 45 of the male housing 12. The female frame 15 is locked doubly by the lock 19 and the bracket 16.

The bracket 16 is a rigid metal plate and is to be provided on an unillustrated fixing body used to mount the connector. At least one locking section 44 penetrates the bracket 16 in thickness direction TD, and engages an engaging portion 45 of the male housing 12.

Figure 8:
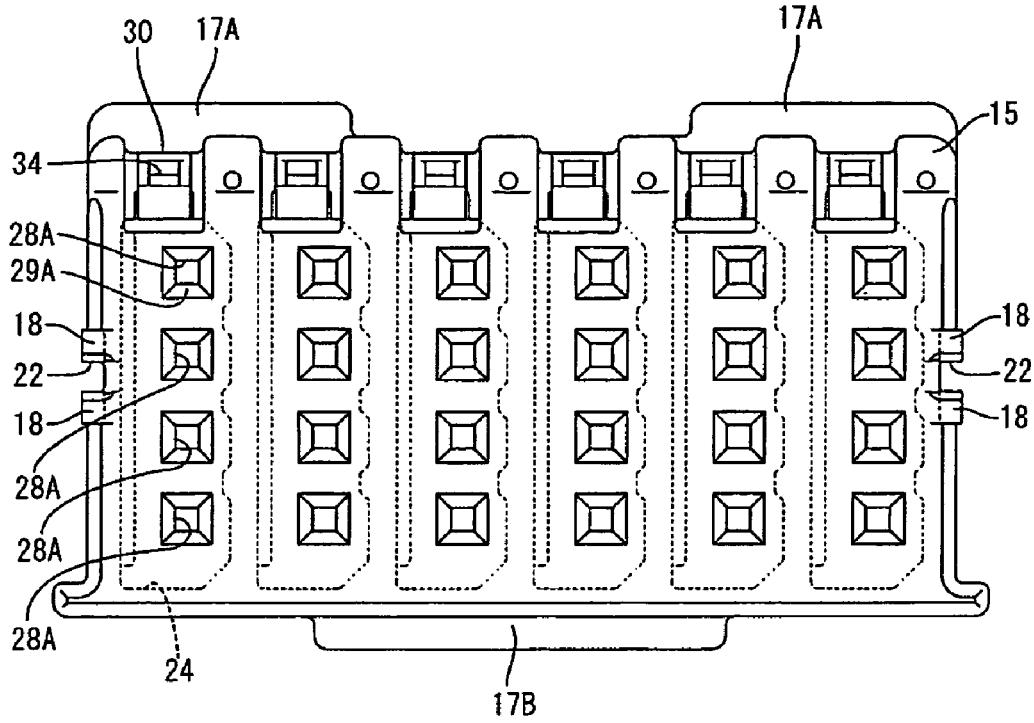
FIG. 8 is a front view of the female frame.
Figure 9:
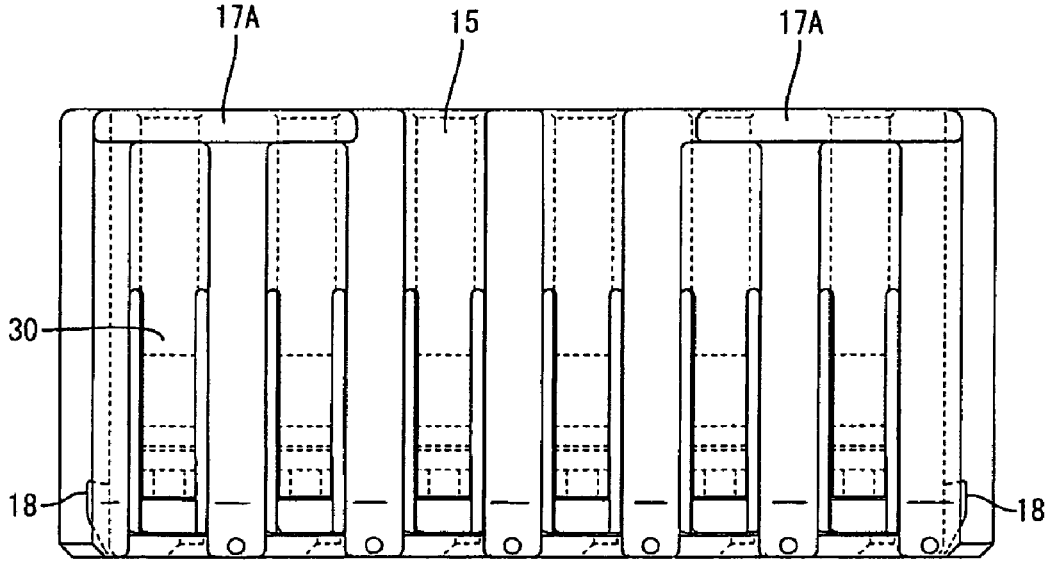
FIG. 9 is a plan view of the female frame.
Figure 10:
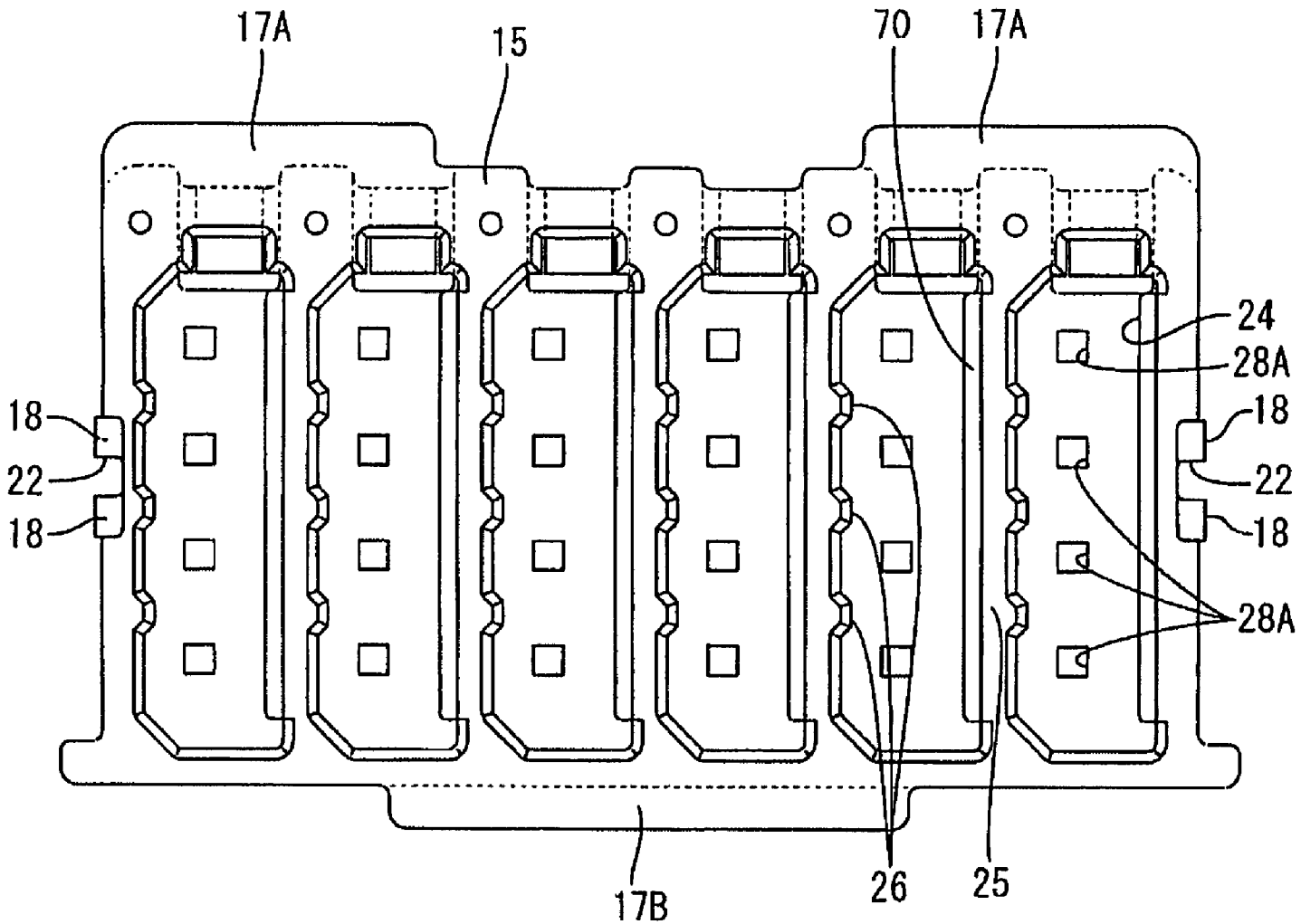
FIG. 10 is a rear view of the female frame.

The female frame 15 is made e.g. of a synthetic resin and is substantially in the form of a block. As shown in FIG. 10, accommodating chambers 24 are formed in the female frame 15 for receiving the auxiliary connectors 14 from behind. The accommodating chambers 24 are arranged side by side along the width direction WD and open in the rear of the female frame 15. Each accommodating chamber 24 is long and narrow along a vertical direction that is normal to the width direction WD, and partition walls 25 separate adjacent accommodating chambers 24. Ribs 26 project in from the left wall of each accommodating chamber 24 in FIG. 10. The ribs 26 extend forward from the rear edge of the female frame 15, and engage guiding grooves 27 in the auxiliary connectors 14 to guide the auxiliary connectors 14 into the accommodating chambers 24. Reinforcements 70 project in from the right wall of each accommodating chamber 24 in FIG. 10 to reinforce the partition wall 25. The rear edge of the reinforcement 70 contacts the front edge of a retainer 39 from the front to stop the auxiliary connector 14 at its front end position. Male tab insertion holes 28A are formed one above another in the front wall of each accommodating chamber 24 for receiving male tabs 10. A slanted surface 29A is formed at the opening edge of each male tab insertion hole 28A, as shown in FIG. 8, for guiding the insertion of the male tab 10. The ribs 26 are arranged at positions between the male tab insertion holes 28A along the vertically direction.

A housing lock 30 is formed in the ceiling wall of each accommodating chamber 24 and cantilevers forward, as shown in FIG. 1. Parts of the female frame 15 before the housing locks 30 are cut off for receiving a disengagement jig 71. The jig 71 can deform the housing locks 30 in an unlocking direction to separate the female frame 15 from the male housing 12.

A resiliently deformable arm 31 is defined at the free front end of each frame side lock 30. A locking projection 32 projects from the lower surface of the arm 31 and into the accommodating chamber 24 at a position slightly retracted from the front end. The locking projection 32 is engageable with a partial lock 33 of the auxiliary connector 14 for retaining the auxiliary connector 14 at a proper position in the accommodating chamber 24. An inclined surface 20B is formed at the rear of the locking projection 32 so that the locking projection 32 can move easily onto the partial lock 33 of the auxiliary connector 14, whereas a locking surface 21B is formed at the front of the locking projection 33 and inclines towards the back. A disengagement recess 34 is formed in the front end surface of the arm 31 for receiving the leading end of the disengagement jig 71 for forcibly deforming the frame side lock 30 (see FIGS. 29 and 30).

The finger placing portions 17A project out from the opposite left and right ends of the rear edge of the upper wall of the female frame 15 in FIG. 8. Further, the finger placing portion 17B projects down from a position near the transverse center of the rear edge of the bottom wall of the female frame 15 in FIG. 8. Thus, an operator can easily hold the finger placing portions 17A, 17B by the fingers to separate the female frame 15 from the male housing 12.

Figure 7:
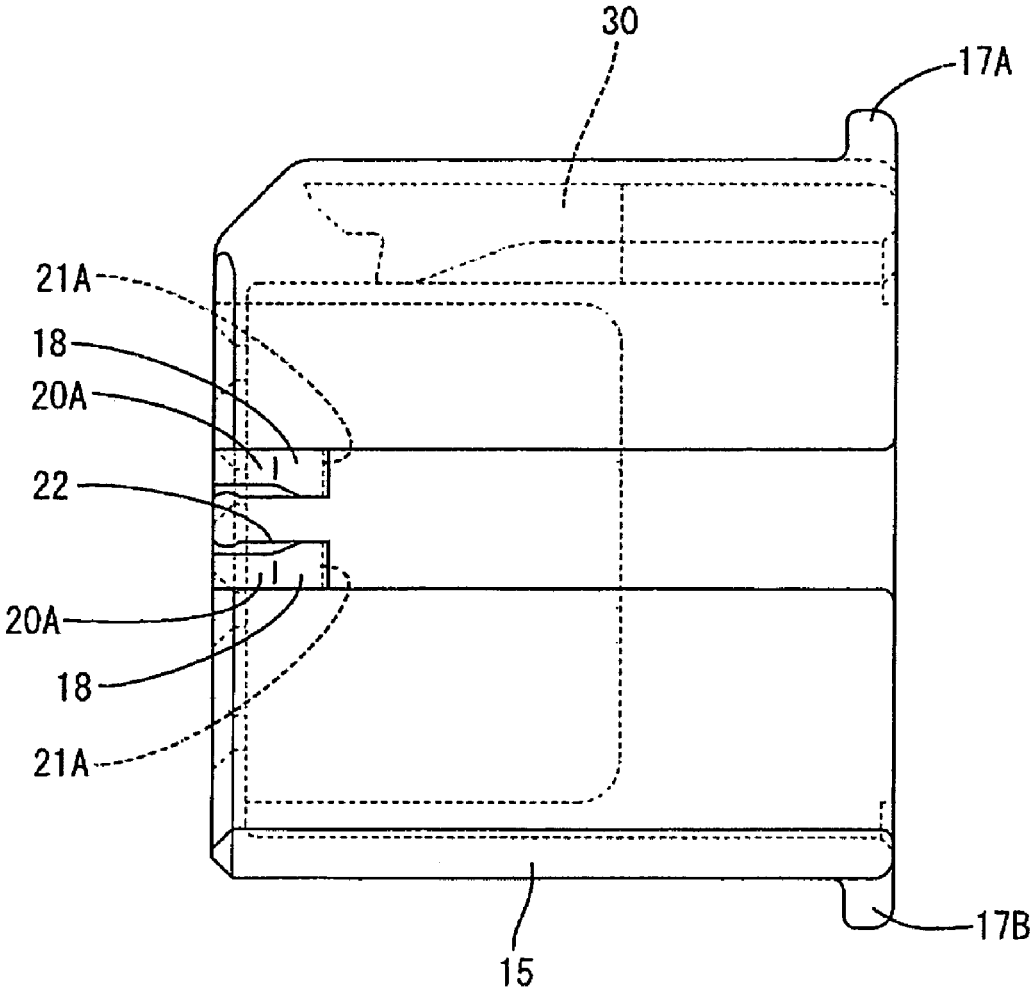
FIG. 7 is a side view of a female frame.

Interlocking portions 18 project transversely out from intermediate positions near the vertical centers of the opposite left and right walls of the female frame 15, as shown in FIG. 8, and are engageable with locks 19 of the male housing 12. As shown in FIG. 5, the front surface of each interlocking portion 18 is slanted for facilitating a movement of the lock 19 onto the interlocking portion 18. A locking surface 21A is formed at the rear of the interlocking portion 18 and is inclined slightly back towards its projecting end. As shown in FIG. 7, a guiding groove 22 is formed near a vertical middle position of each interlocking portion 18 and extends in forward and backward directions FBD. The guiding grooves 22 engage collision preventing ribs 23 of the male housing 12 so that the female frame 15 cannot enter the male housing 12 in an inclined posture. Thus, the front end of the female frame 15 will not collide with the male tabs 10. The guiding grooves 22 engage with collision preventing ribs 23 of the male housing 12 to prevent the female frame 15 from entering the male housing 12 in an inclined posture and thereby preventing the front end of the female frame 15 from colliding with the tabs 10. When the female frame 15 is fit into the receptacle 46 of the male housing 12, the inclined surfaces 20A of the interlocking portions 18 of the female frame 15 slide in contact with the inclined surfaces 20D of the lock projections 63 of the male housing 12 from the front and, accordingly, the locks 19 deform into the deformation areas 62. The lock projections 63 of the locks 19 move over the interlocking portions 18 of the female frame 15 when the female frame 15 is fit to a properly inserted state. Thus, the locks 19 restore resiliently so that the locking surfaces 21D of the lock projections 63 contact the locking surfaces 21A of the interlocking portions 18 of the female frame 15 to retain the female frame 15.

Figure 11:
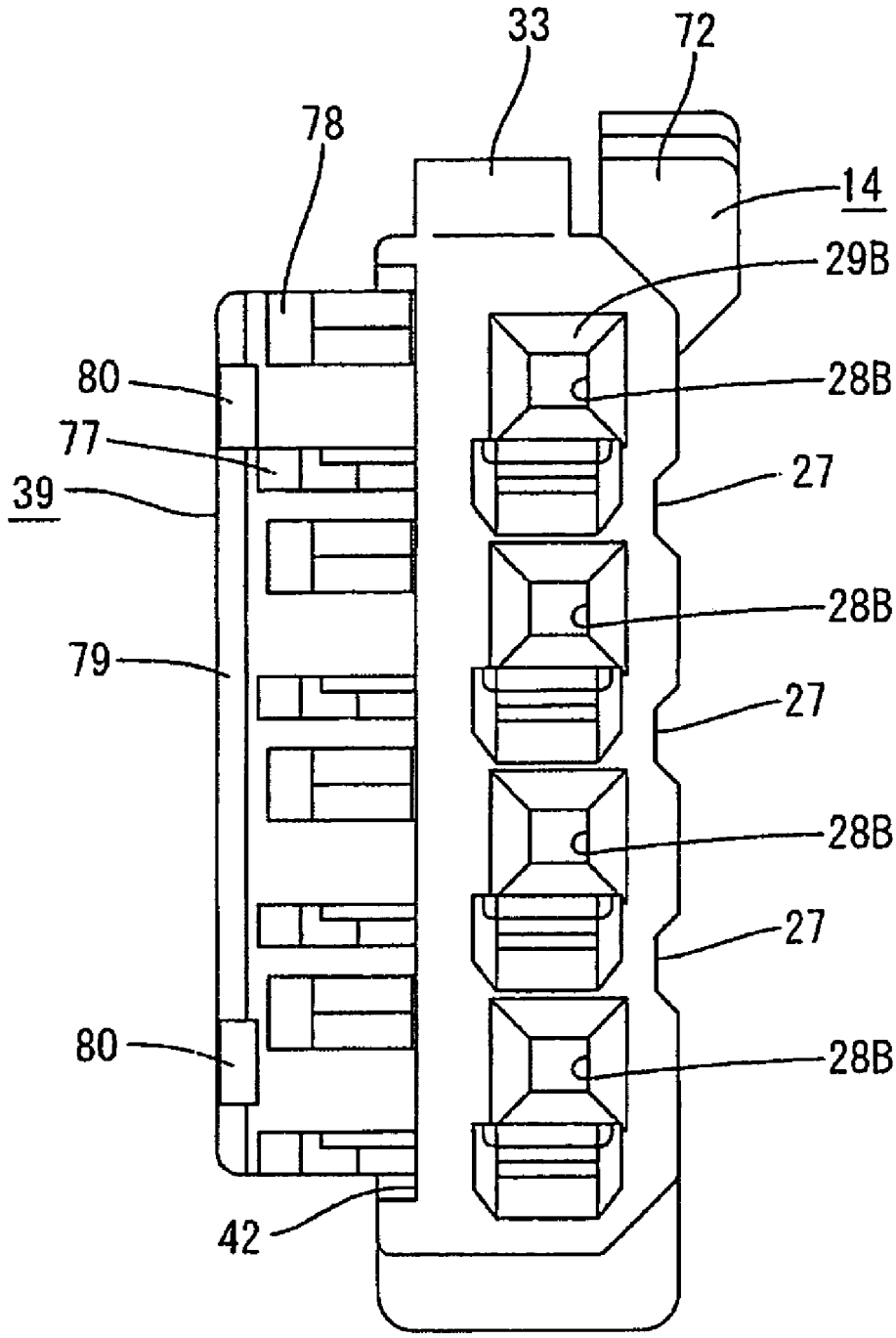
FIG. 11 is a front view of an auxiliary connector showing a state where a retainer is not accommodated in retainer accommodating holes.
Figure 14:
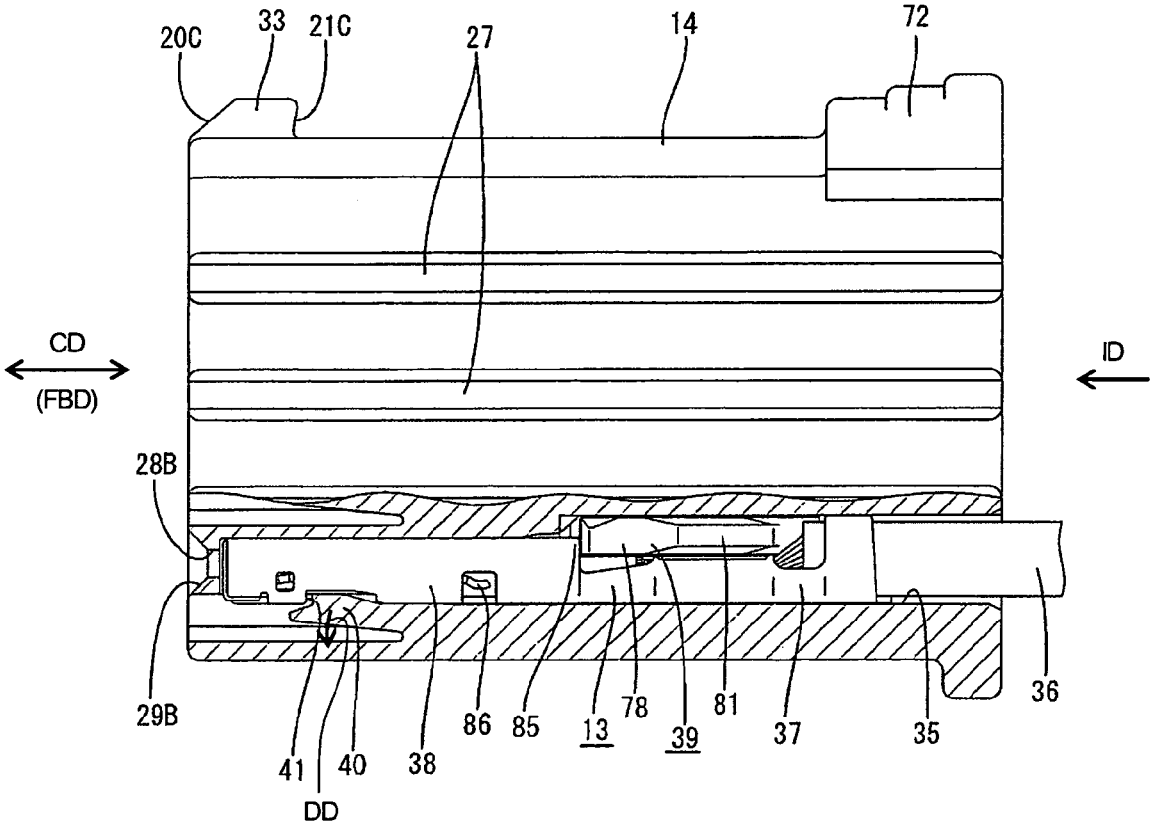
FIG. 14 is a side view partly in section showing a side surface of the auxiliary connector opposite to the one where the retainer is formed with the female terminal fittings inserted in the auxiliary connector.
Figure 15:
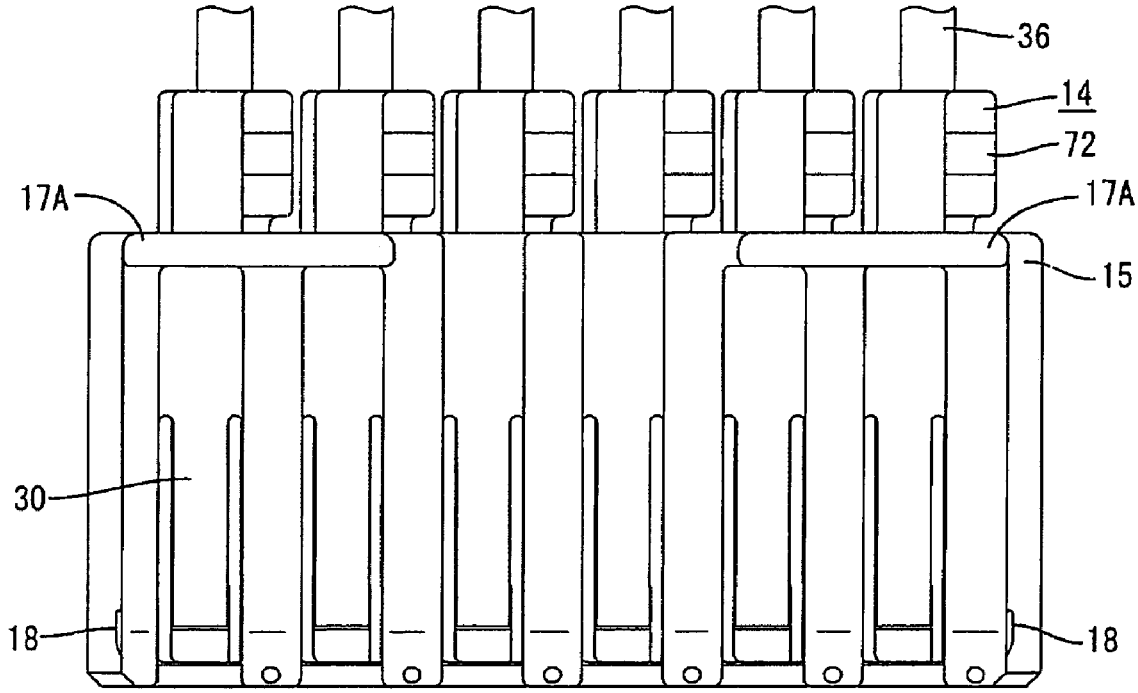
FIG. 15 is a plan view showing a state where the auxiliary connectors are inserted in the female frame.

Each auxiliary connector 14 is made e.g. of a synthetic resin and has a flat shape with a small dimension in the width direction WD, as shown in FIGS. 11 to 14. As shown in FIG. 14, four cavities 35 are formed in each auxiliary connector 14 for accommodating the female terminal fittings 13 that are connected to ends of wires 36. The cavities 35 are formed one above another in the vertical direction in FIG. 14 and extend in forward and backward directions FBD (transversely in FIG. 14). Each female terminal fitting 13 includes a barrel 37 to be crimped, bent or folded into connection with the wire 36. A connecting tube 38 is formed before the barrel 37 and is designed to establish electrical connection with the busbar 11 by insertion of the male tab 10 therein. A locking hole 41 is formed in the bottom wall of the connecting tube 38. A retainer 39 is engaged with the rear edges of the connecting tubes 38 for double locking when the female terminal fittings 13 are inserted properly. A resilient contact piece 86 extends from the front edge of the bottom wall of the connecting tube 38 and is folded back inwardly. The resilient contact piece 86 is formed to be substantially mountain-shaped or pointed when viewed sideways. As shown in FIG. 11, a male tab insertion hole 28B is formed in the front wall of each cavity 35 for receiving the male tab 10, and a tapered surface 29B is formed at the opening edge of each male tab insertion hole 28B for guiding the insertion of the male tab 10.

The lock 40 is cantilevered forward from the bottom wall of each cavity 35 and is engageable with the locking hole 41 of the female terminal fitting 13 to prevent the female terminal fitting 13 from coming out backward. The lock 40 is resiliently deformable in and out in a deforming direction DD that intersects the insertion and withdrawal direction of the terminal fittings 13 into and from the cavities 35 to prevent vertical displacements of the female terminal fitting 13. Further, the cavities 35 are arranged in the resiliently deforming direction DD of the locks 40.

The partial lock 33 projects out and up near the front end (right end in FIG. 13) of the upper wall of the auxiliary connector 14. An inclined surface 20C is formed at the front of the partial lock 33 so that the locking section 44 of the housing lock 30 can move easily onto the partial lock 33. A locking surface 21C is formed at the rear of the partial lock 33 and inclines back towards the top. The auxiliary connector 14 can be inserted into the accommodating chamber 24 of the female frame 15 from behind. As a result, the inclined surface 20C of the partial lock 33 of the auxiliary connector 14 slides in contact with the inclined surface 20B of the locking projection 32 of the frame side lock 30. Accordingly, the housing lock 30 deforms up and out in the unlocking direction UD. The locking projection 32 of the housing lock 30 moves over the partial lock 33 of the auxiliary connector 14 and the housing lock 30 resiliently restores when the auxiliary connector 14 is inserted properly inserted. As a result, the locking surface 21B of the locking projection 32 of the housing lock 30 contacts the locking surface 21C of the partial lock 33 of the auxiliary connector 14 from behind. In this way, the auxiliary connector 14 is prevented from coming out backward (see FIG. 1).

A connector side finger placing portion 72 projects up and out from the rear end (left end in FIG. 13) of the upper wall of the auxiliary connector 14. The operator can easily detach the auxiliary connector 14 from the female frame 15 by holding the connector side finger placing portion 72 by a finger. The connector side finger placing portion 72 is at a position deviated from the partial lock 33 in a direction (rightward direction in FIG. 11) intersecting with the inserting direction ID of the auxiliary connector 14 into the female frame 15. As shown in FIG. 4, the connector side finger placing portions 72 are behind the partition walls 25 that separate the respective accommodating chambers 24 when the auxiliary connectors 14 are at proper positions in the accommodating chambers 24 of the female frame 15.

Figure 12:
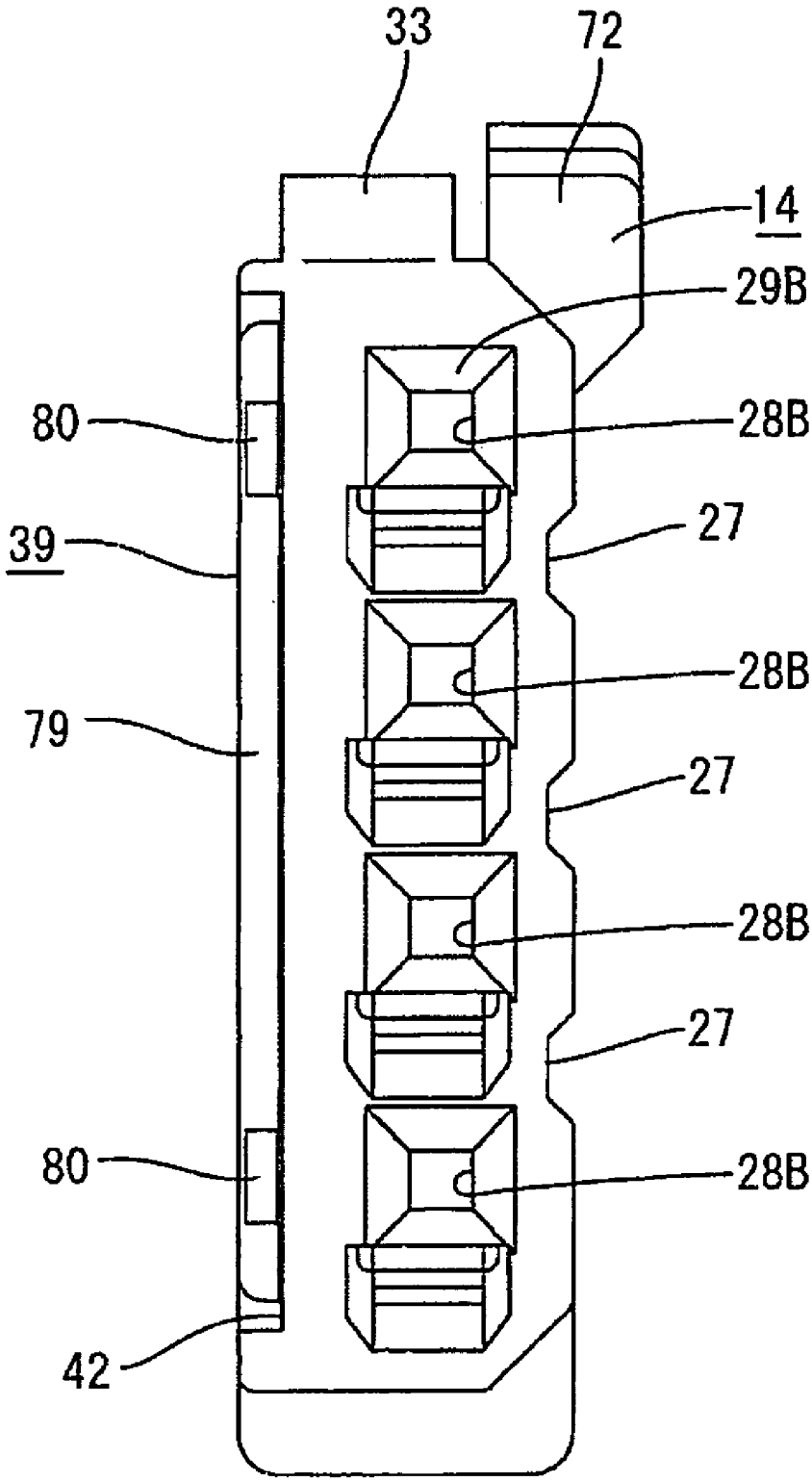
FIG. 12 is a front view of the auxiliary connector showing a state where the retainer is accommodated in the retainer accommodating holes.
Figure 13:
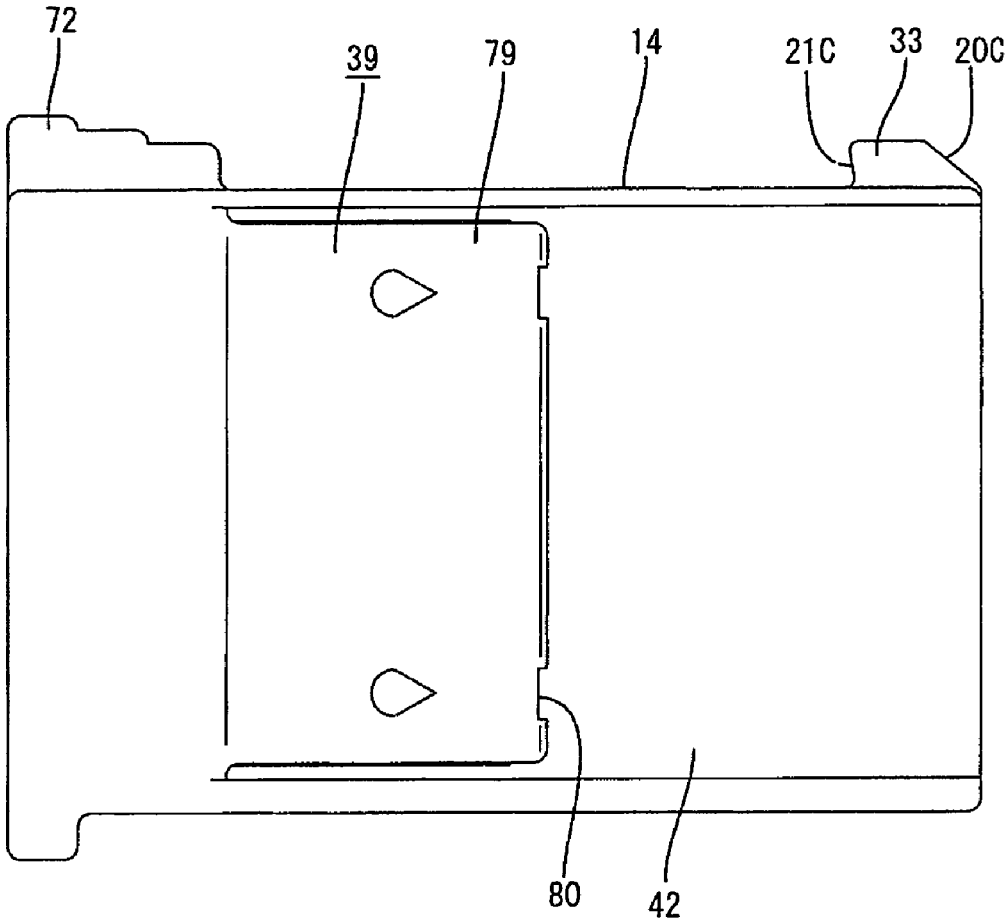
FIG. 13 is a side view showing a side surface of the auxiliary connector where the retainer is formed.

Three guiding grooves 27 extend in forward and backward directions FBD along the right wall of each auxiliary connector 14, as shown in FIGS. 11 and 12. The guiding grooves 27 are disposed one above another and are engageable with the ribs 26 of the female frame 15. The guiding grooves 27 are formed by cutting inwardly into the material between the vertically arranged cavities 35. Thus, even though the female frame 15 has the ribs 26, the entire divided connector is not enlarged in the width direction WD.

Retainer accommodating holes 73 are formed at positions of a left wall 42 of each auxiliary connector 14 in FIGS. 11 and 12 corresponding to the respective cavities 35 (see FIG. 26) and have depths to communicate with the respective cavities 35. Full locking projection accommodating holes 74 are formed at positions of the left wall 42 corresponding to the bottom walls of the cavities 35 and have depths to communicate with the respective cavities 35. The rear opening edges of the retainer accommodating holes 73 and the full locking projection accommodating holes 74 align vertically, whereas front opening edges of the full locking projection accommodating holes 74 are before those of the retainer accommodating holes 73. The retainer 39 is formed unitarily formed with the auxiliary connector 14 at the rear opening edges of the retainer accommodating holes 73 and the full locking projection accommodating holes 74 via a vertically extending hinge 75. Thus, the number of parts can be reduced as compared to the case where the retainer 39 is formed as a separate member. The retainer 39 is swingable or pivotable about the hinge 75 along a direction intersecting the resiliently deforming direction DD of the locks 40 between a partial locking position where the female terminal fittings 13 are insertable and a full locking position where the retainer 39 is engaged with the female terminal fittings 13 to retain the female terminal fittings 13. Thus the rotational axis of the hinge 75 is substantially parallel to the deforming direction DD of the locks 40.

Figure 24:
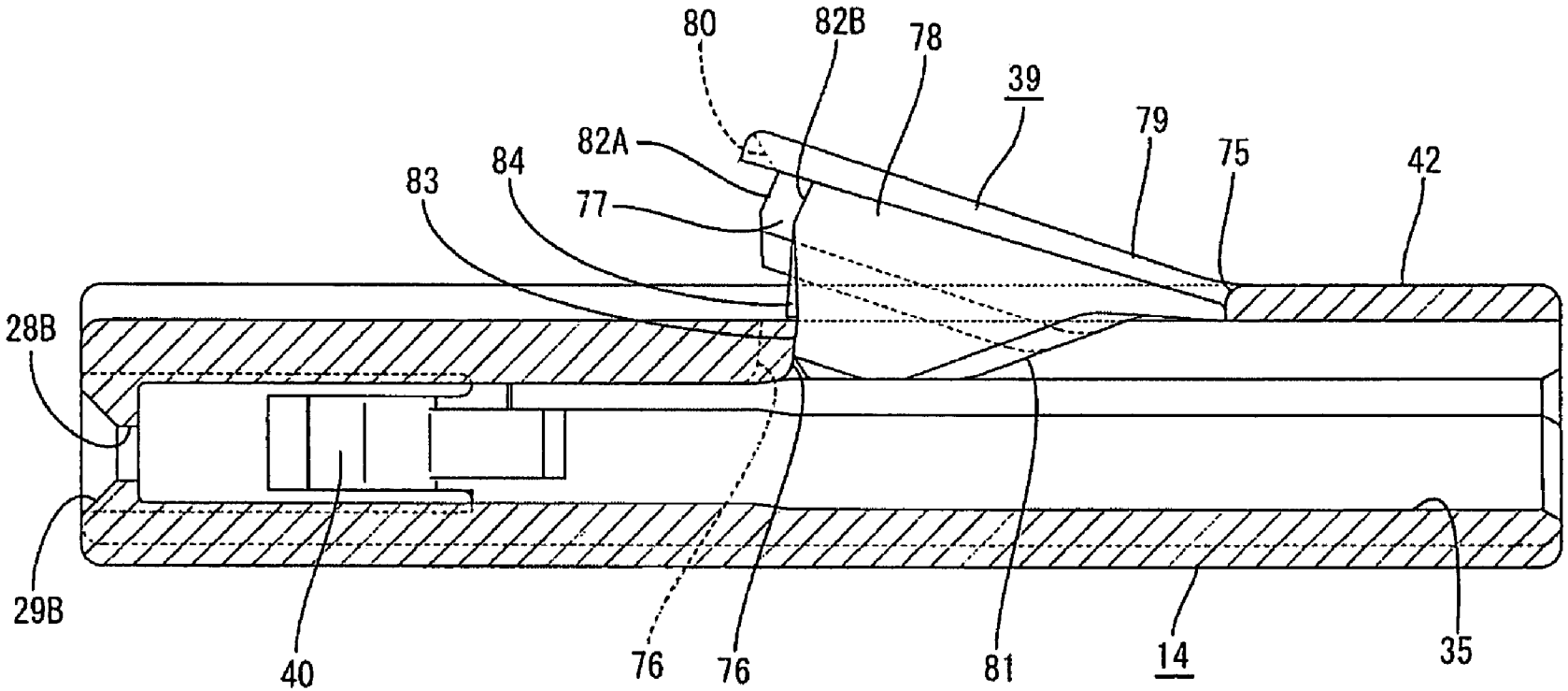
FIG. 24 is a plan view in section showing a state where the retainer is held at a partial locking position in the auxiliary connector.

As shown in FIG. 24, engageable surfaces 76 are formed at the front opening edges of the retainer accommodating holes 73 and the full locking projection accommodating holes 74. The engageable surfaces 76 incline back towards the outer side in the thickness direction of the left wall 42 of the auxiliary connector 14 and are engageable with full locking projections 77. Locking protrusions 78 hold the retainer 39 at the partial locking position and the full locking position.

The retainer 39 includes a substantially rectangular base plate 79. Locking protrusions 78 project in from positions of the inner surface of the base plate 79 substantially corresponding to the retainer accommodating holes 73 and are engageable with the female terminal fittings 13. Full locking projections 77 project in from positions of the inner surface of the base plate 79 corresponding to the full locking projection accommodating holes 74 and are engageable the edges of the full locking projection accommodating holes 74.

The front end of the base plate 79 projects more forward than the locking protrusions 78 and the full locking projections 77, and recesses 80 are formed at positions of the front end near the upper and bottom ends in FIG. 11. The recesses 80 receive an unillustrated jig to cancel the fully locked state of the retainer 39 held at the full locking position.

Each full locking projection 77 preferably is a substantially rectangular plate when viewed from above, and a push-out inclined surface 81 is formed at the rear of the full locking projection 77. The front end of the female terminal fitting 13 can be brought into sliding contact with the inclined surface 81 for pushing the retainer 39 out of the retainer accommodating holes 73 when the female terminal fitting 13 is inserted with the retainer 39 at least partly accommodated in the retainer accommodating holes 73. The full locking projections 77 are at the bottom walls of the cavities 35 when the retainer 39 is at the full locking position. A full locking surface 82A is formed at the front end of each full locking projection 77 and inclines back towards the outer side in the thickness direction of the left wall 42 of the auxiliary connector 14 when the retainer 39 is at the full locking position.

Each locking protrusion 78 has a fan- or arc-shape substantially centered on the hinge 75 when viewed from above, and corresponding to a distance between the opening edge of the retainer accommodating hole 73 connected to the hinge 75 and the opening edge thereof opposite the hinge 75. The push-out inclined surface 81 is at the rear of the inner surface of the locking protrusion 78 and can achieve sliding contact with the front end of the female terminal fitting 13 for pushing the retainer 39 out of the retainer accommodating hole 73 if the female terminal fitting 13 is inserted while the retainer 39 is in the retainer accommodating hole 73. The push-out inclined surface 81 is inclined backward (rightward in FIG. 24) towards the outer side (upper side in FIG. 24) in the thickness direction of the left wall 42 of the auxiliary connector 14. A partial locking surface 83 is formed at the front inner part of the locking protrusion 78 and is inclined forward toward the outer side in the thickness direction of the left wall 42 of the auxiliary connector 14 when the retainer 39 is at the partial locking position. A partial locking projection 84 projects forward from an outer side of the partial locking surface 83 and contacts the outer surface of the left wall 42 of the auxiliary connector 14 from the outer side when the retainer 39 is at the partial locking position. A full locking surface 82B is formed at the front outer part of the locking protrusion 78 and inclines back towards the outer side in the thickness direction of the left wall 42 when the retainer 39 is at the full locking position.

Figure 27:
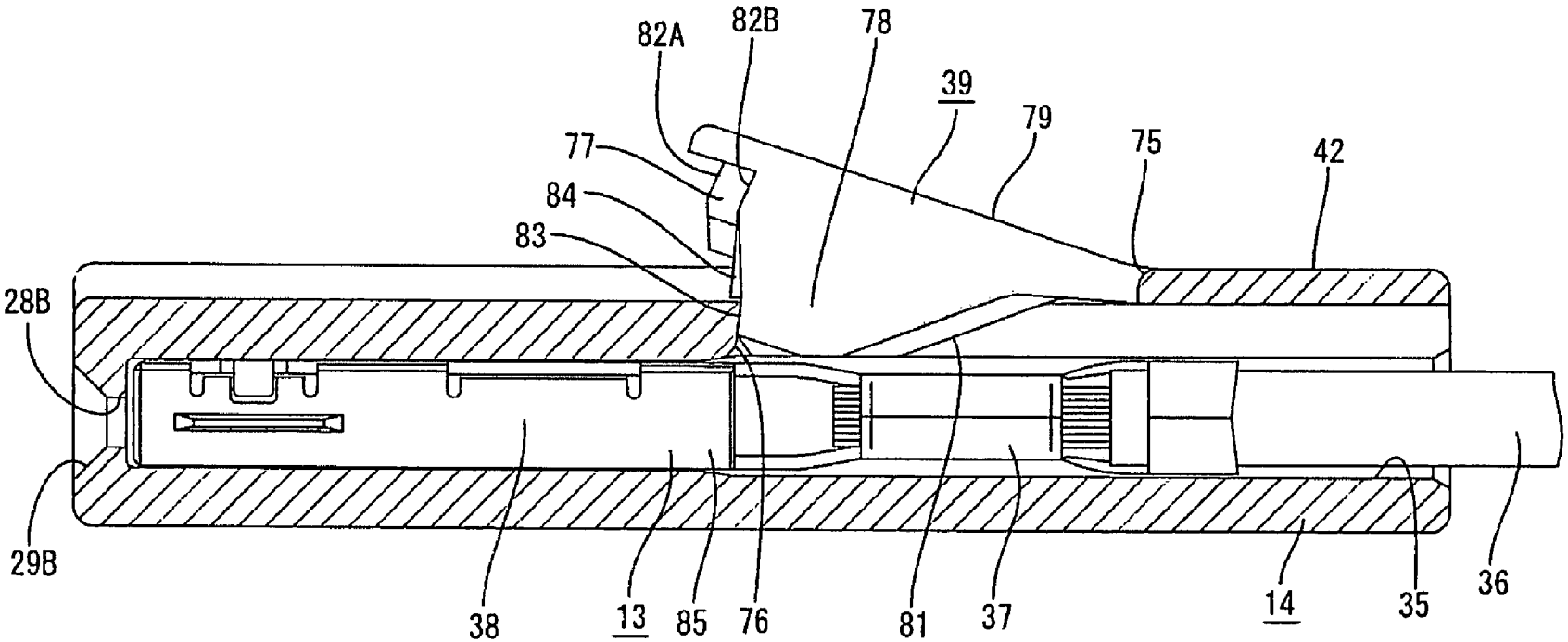
FIG. 27 is a plan view in section showing a state where the retainer is held at the partial locking position in the auxiliary connector with the female terminal fitting inserted in the cavity.

As shown in FIG. 24, the engageable surfaces 76 of the retainer accommodating holes 73 and the partial locking surfaces 83 of the retainer 39 engage each other when the retainer 39 is at the partial locking position. The engageable surfaces 76 and the partial locking surfaces 83 of the retainer 39 are inclined towards the outer side in the thickness direction of the left wall 42 of the auxiliary connector 14. Thus, the engagement of the engageable surfaces 76 and the partial locking surfaces 83 prevents an outward displacement of the retainer 39 in the thickness direction of the left wall 42 of the auxiliary connector 14. The partial locking projections 84 of the retainer 39 contact the opening edges of the retainer accommodating holes 73 from the outer side to resist having the retainer 39 pushed inadvertently into the retainer accommodating holes 73 and to the full locking position. As shown in FIG. 27, the female terminal fittings 13 are insertable into the cavities 35 when the retainer 39 is at the partial locking position.

Figure 25:
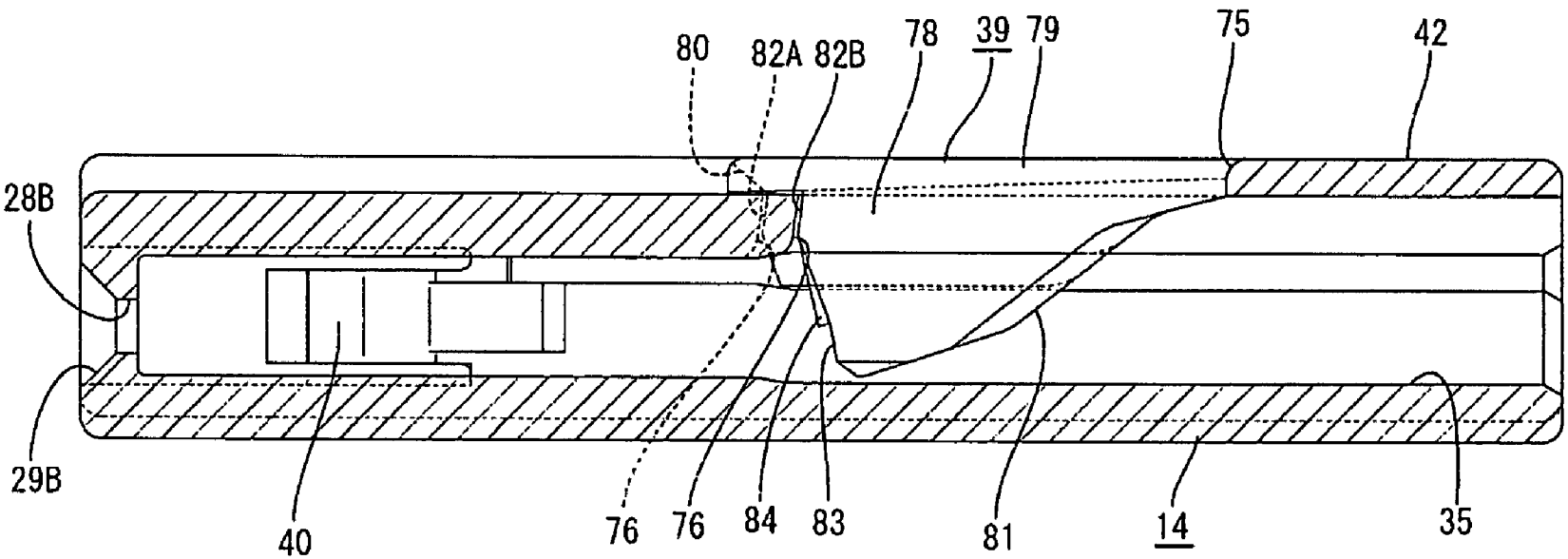
FIG. 25 is a plan view in section showing a state where the retainer is held at a full locking position in the auxiliary connector.
Figure 26:
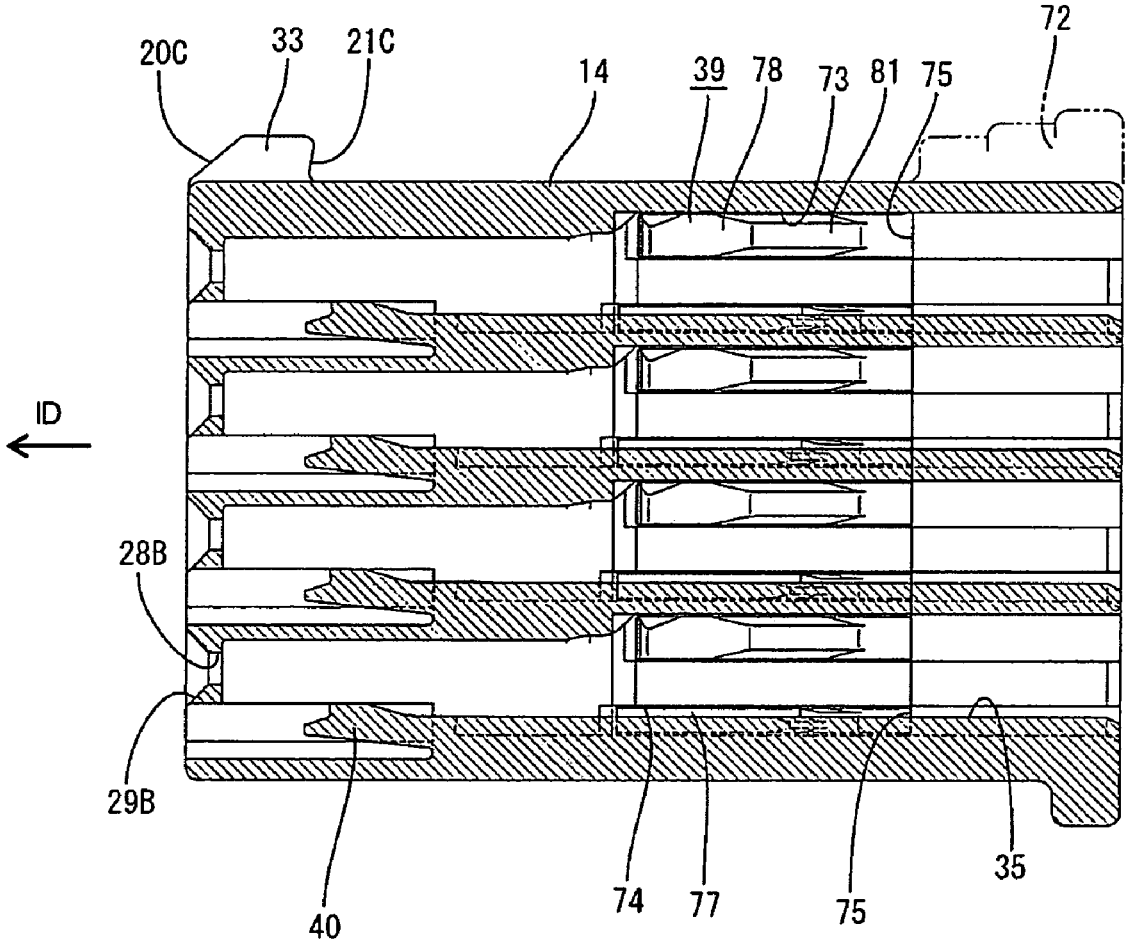
FIG. 26 is a side view in section showing the state where the retainer is held at the full locking position in the auxiliary connector.

The partial locking projections 84 move over and disengage from the opening edges of the retainer accommodating holes 73 if the retainer 39 is pushed in from the partial locking position towards the retainer accommodating holes 73. Thus, the retainer 39 is displaceable from the partial locking position to the full locking position. As shown in FIG. 25, the engageable surfaces 76 of the retainer accommodating holes 73 and the full locking surfaces 82B of the locking protrusions 78 engage each other when the retainer 39 is at the full locking position. The engageable surfaces 76 and the full locking surface 82B of the locking projections 78 are inclined back towards the outer side in the thickness direction of the left wall 42 of the auxiliary connector 14. Thus, the engagement of the engageable surfaces 76 and the full locking surfaces 82A prevent outward displacement of the retainer 39 in the thickness direction of the left wall 42 of the auxiliary connector 14.

The full locking projections 77 are in the respective full locking projection accommodating holes 74 when the retainer 39 is at the full locking position, and the engageable surfaces 76 of the full locking projection accommodating holes 74 engage the full locking surfaces 82A of the full locking projections 77. The engageable surfaces 76 are inclined back towards the outer side in the thickness direction of the left wall 42 of the auxiliary connector 14, and the full locking surfaces 82A of the full locking projections 77 are inclined back towards the outer side in the thickness direction of the left wall 42 of the auxiliary connector 14. Thus, engagement of the engageable surfaces 76 and the full locking surfaces 82A prevents an outward displacement of the retainer 39 in the thickness direction of the left wall 42 of the auxiliary connector 14.

In this way, the full locking surfaces 82B of the locking protrusions 78 engage the engageable surfaces 76 of the retainer accommodating holes 73 and the full locking surfaces 82A of the full locking projections 77 engage the engageable surfaces 76 of the full locking projection accommodating holes 74 when the retainer 39 is at the full locking position. Therefore, outward displacement of the retainer 39 in the thickness direction of the left wall 42 of the auxiliary connector 14 is prevented.

The front end surface of the base plate 79 of the retainer 39 contacts the opening edges of both the retainer accommodating holes 73 and the full locking projection accommodating holes 74 from the outer side when the retainer 39 is at the full locking position to prevent displacement of the retainer 39 toward the inner sides of the retainer accommodating holes 73.

The locking protrusions 78 are at substantially the same relative positions in the cavities 35 of the respective stages when viewed from above while the retainer 39 is at the full locking position.

Figure 28:
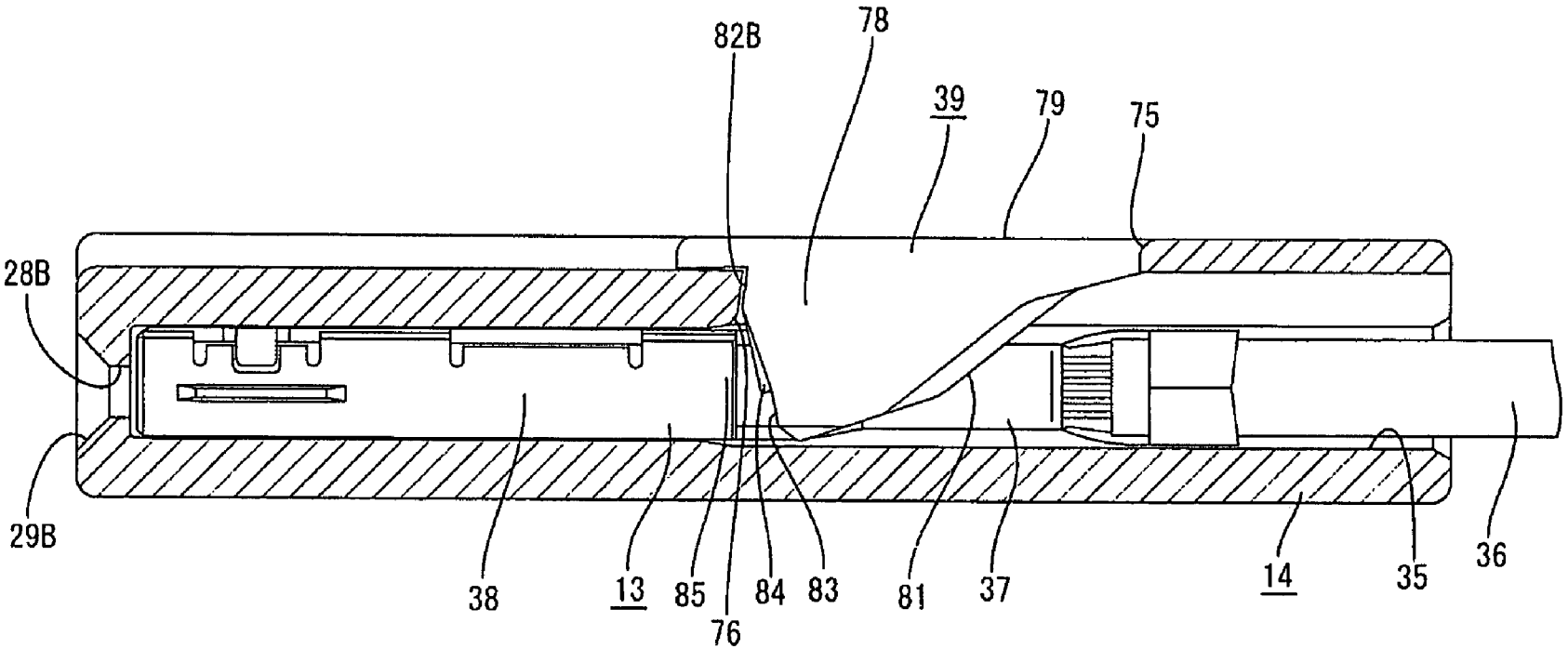
FIG. 28 is a plan view in section showing a state where the retainer is held at the full locking position in the auxiliary connector with the female terminal fitting inserted in the cavity.

As shown in FIG. 28, the locking protrusions 78 of the retainer 39 engage the rear edges 85 of the connecting tubes 38 of the female terminal fittings 13 from the outer side in the thickness direction of the left wall 42 of the auxiliary connector 14 and in a direction intersecting with the deforming direction DD of the locks 40 when the retainer 39 is at the full locking position. Thus, the retainer 39 prevents displacements of the female terminal fittings 13 along the direction intersecting with the deforming direction DD of the lock 40. The retainer 39 also contacts the rear edges 85 of the connecting tubes 38 of the female terminal fittings 13 from behind. Thus, the female terminal fittings 13 are locked redundantly by the locks 40 and the retainer 39.

The locking protrusions 78 are at substantially the same positions with respect to forward and backward directions FBD in the cavities 35 at the respective stages when the retainer 39 is at the full locking position. The full locking projections 77 constitute the parts of the bottom walls of the cavities 35 to prevent vertical displacements of the female terminal fittings 13.

The connector is assembled by pushing the busbars 11 into the busbar holding grooves 48 of the male housing 12 from the front so that the fixing portions 50 of the busbars 11 are pressed into the fixing holes 51 of the busbar holding grooves 48. Thus, the busbars 11 are fixed in the busbar holding grooves 48 and the male tabs 10 thereof project into the receptacle 46. In this state, the busbars 11 are arranged in their thickness direction.

Next, with the retainer 39 at the partial locking position, the female terminal fittings 13 mounted at the ends of the wires 36 are inserted into the respective cavities 35 of the auxiliary connectors 14 from behind. As a result, the female terminal fittings 13 are retained by the locks 40. The locks 40 engage the female terminal fittings 13 vertically along the deforming direction DD. Thus, vertical displacements of the female terminal fittings 13 also are restricted. The retainer 39 then is moved to the full locking position. Thus, the locking protrusions 78 of the retainer 39 contact the rear edges 85 of the connecting tubes 38 of the female terminal fittings 13 from behind. Therefore, the female terminal fittings 13 are locked doubly by the locks 40 and the retainer 39. Further, the locking protrusions 78 of the retainer 39 engage the rear edges 85 of the connecting tubes 38 in the direction intersecting with the deforming direction DD of the locks 40 to prevent displacements of the female terminal fittings 13 along the direction intersecting the deforming directions DD of the locks 40 (see FIGS. 14 and 28).

Subsequently, the auxiliary connector 14 having the female terminal fittings 13 therein is inserted into each accommodating chamber 24 of the female frame 15 from behind. The inclined surface 20C of the partial lock 33 of the auxiliary connector 14 slides in contact with the inclined surface 20B of the locking projection 32 of the housing lock 30 from behind during this inserting operation and, accordingly, the housing lock 30 is deformed out and up. The locking projection 32 of the housing lock 30 moves over the partial lock 33 of the auxiliary connector 14 when the auxiliary connector 14 is inserted properly. Thus, the housing lock 30 is restored resiliently, and the locking surface 21B of the locking projection 32 of the housing lock 30 contacts the locking surface 21C of the partial lock 33 of the auxiliary connector 14 from behind to prevent the auxiliary connector 14 from coming out backward. With the auxiliary connector 14 accommodated in the accommodating chamber 24 of the female frame 15, the rear end of the auxiliary connector 14 is exposed through the rear surface of the female frame 15 so that the wires 36 can be drawn rearwardly out of the auxiliary connector 14 (see FIG. 15).

As shown in FIG. 4, the connector side finger placing portions 72 of the auxiliary connectors 14 are behind the partition walls 25 with the auxiliary connectors 14 in the accommodating chambers 24 of the female frame 15.

The ribs 26 on the inner surfaces of the partition walls 25 of the accommodating chambers 24 fit into the respective guiding grooves 27 of the auxiliary connectors 14 to prevent the auxiliary connectors 14 from being inserted in vertical inclined postures into the accommodating chambers 24.

The female frame 15 having the auxiliary connectors 14 accommodated therein then is fit into the receptacle 46 of the male housing 12. As a result, the collision preventing ribs 23 in the receptacle 46 of the male housing 12 enter the guiding grooves 22 in the female frame 15 to prevent the female frame 15 from being inserted into the receptacle in a vertically inclined state. Further, the collision preventing ribs 23 extend back from substantially transversely symmetrical positions of the right and left walls 57, 58 of the receptacle 46 to prevent the female frame 15 from being inserted into the receptacle 46 in a posture inclined so that one of the left and right sides of the front end of the female frame 15 precedes the other. In this way, the front end of the female frame 15 will not collide with the male tabs 10 projecting in the receptacle 46.

The inclined surfaces 20A of the interlocking portions 18 of the female frame 15 slide in contact with the inclined surfaces 20D of the lock projections 63 of the male housing 12 from the front as the female frame 15 is inserted into the receptacle 46. Accordingly, the locks 19 deform into the deformation areas 62. The lock projections 63 of the locks 19 move over the interlocking portions 18 of the female frame 15 when the female frame 15 is inserted properly. As a result, the locks 19 restore resiliently and the locking surfaces 21D of the lock projections 63 contact the locking surfaces 21A of the interlocking portions 18 of the female frame 15 to retain the female frame 15.

When the male housing 12 and the female frame 15 are connected properly, the male tabs 10 of the male housing 12 are inserted through the male tab insertion holes 28A of the female frame 15, through the male tab insertion holes 28B of the auxiliary connectors 14 and into the connecting tubes 38 of the female terminal fillings 13. Thus, the plate surfaces of the tabs 10 facing in the thickness direction thereof contact the resilient contact piece 86 to connect the busbars 11 and the female terminal fillings 13 electrically. As a result, specified female terminal fillings 13 are shorted by the busbars 11.

The housing lock 30 of the female frame 15 does not resiliently restore completely if the auxiliary connector 14 is fit only partly into the female frame 15, as shown in FIG. 23. An attempt could be made to connect the female frame 15 with the male housing 12 in this state. However, the front end of the still-deformed housing lock 30 will contact the front end of the partial connection detecting rib 54 from the front to hinder the insertion of the auxiliary connector 14, thereby indicating the partial connection of the auxiliary connector 14. The front end of the housing lock 30 has a converging configuration (e.g. inclined back towards the bottom), whereas the front end of the partial connection detecting rib 54 has a converging configuration inclined in a complementary manner (back toward the top) to the converging configuration of the partial connection detecting rib 54. Thus, if the front end of the housing lock 30 and the front end of the partial connection detecting rib 54 contact each other, they slide in contact to engage the back sides of the mating parts. Therefore, the partly connected state can be detected.

The bracket 16 is inserted between the guide rails 55 of the male housing 12 when the male housing 12 and the female frame 15 are connected properly. First, the outer surface of the bracket guide 56 of the male housing 12 contacts the leading end of the bracket 16 to guide the bracket 16 into the clearance between the guide rails 55. The male housing 12 is pushed forward (rightward in FIG. 6) with the bracket 16 contacting the bracket guide 56. As a result, the leading end of the bracket 16 contacts the inclined surface 20E of the engaging portion 45 of the male housing 12 from the front. The bracket 16 then moves over the engaging portion 45 and is restored resiliently. As a result, the engaging portion 45 of the male housing 12 is fit into the locking section 44 of the bracket 16 to bring the locking surface 21E of the engaging portion 45 into contact with the opening edge of the locking section 44 of the bracket 16 from the front. In this way, the bracket 16 is locked. In this state, the leading end of the bracket 16 enters the deformation area 62 outside the lock 19 of the male housing 12 in the thickness direction of the left wall 58, thereby preventing the lock 19 from deforming into the deformation area 62. As a result, even if a force acts to separate the male housing 12 from the female frame 15, the lock 19 cannot deform to disengage the lock projection 63 from the interlocking portion 18 of the female frame 15. Therefore, the male housing 12 and the female frame 15 are locked together with an increased force.

The locks 19 extend back (leftward in FIG. 6) from the base ends 60 toward the free ends 61, and this extending direction is along the inserting direction ID (leftward in FIG. 6) of the bracket 16 into the clearance between the guide rails 16. The bracket 16 is inserted in the inserting direction ID between the guide rails 55 from the base end side of the lock 19. Thus, deformation of the base end of the lock 19 can be prevented more securely. As a result, the male housing 12 and the female frame 15 can be locked into each other with an even increased force.

The connector may have to be disassembled for maintenance. Thus, the bracket 16 is deformed out by an unillustrated jig to disengage the engaging portion 45 from the lock 44. The male housing 12 then is pulled back to separate the male housing 12 and the bracket 16 from each other.

Subsequently, the locks 19 are deformed into the deformation areas 62 by an unillustrated jig to disengage the locks 19 and the interlocking portions 18, and the male housing 12 and female frame 15 are pulled back away from each other to be separated. The notches 52 at the front edges of the ceiling and bottom walls of the receptacle 46 of the male housing 12 easily enable an operator to place fingers on the finger placing portions 17A, 17B. The finger placing portions 17A, 17B of the female frame 15 are in the notches 52, and the finger placing slants 53A, 53B are on the upper surface of the ceiling wall and on the lower surface of the bottom wall. The operator can pull the female frame 15 back by placing an index finger and middle finger on the finger placing portions 17A on the ceiling wall and a thumb on the finger placing portion 17B on the bottom wall. Thus, forces can be exerted to the female frame 15 in a vertically well-balanced manner to improve operation efficiency.

Figure 29:
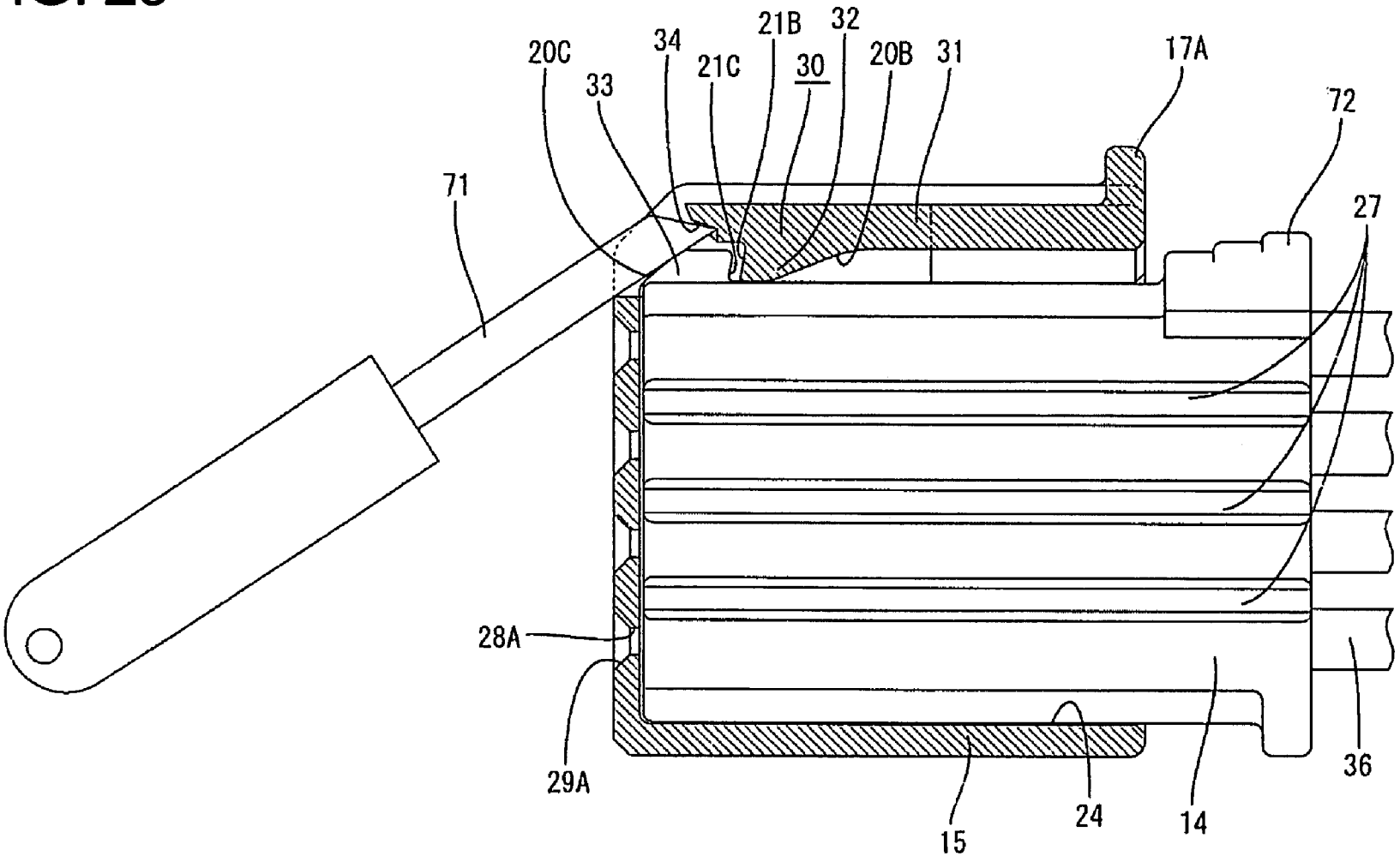
FIG. 29 is a side view in section showing a state where a disengagement jig is brought into contact with a disengagement recess 80.
Figure 30:
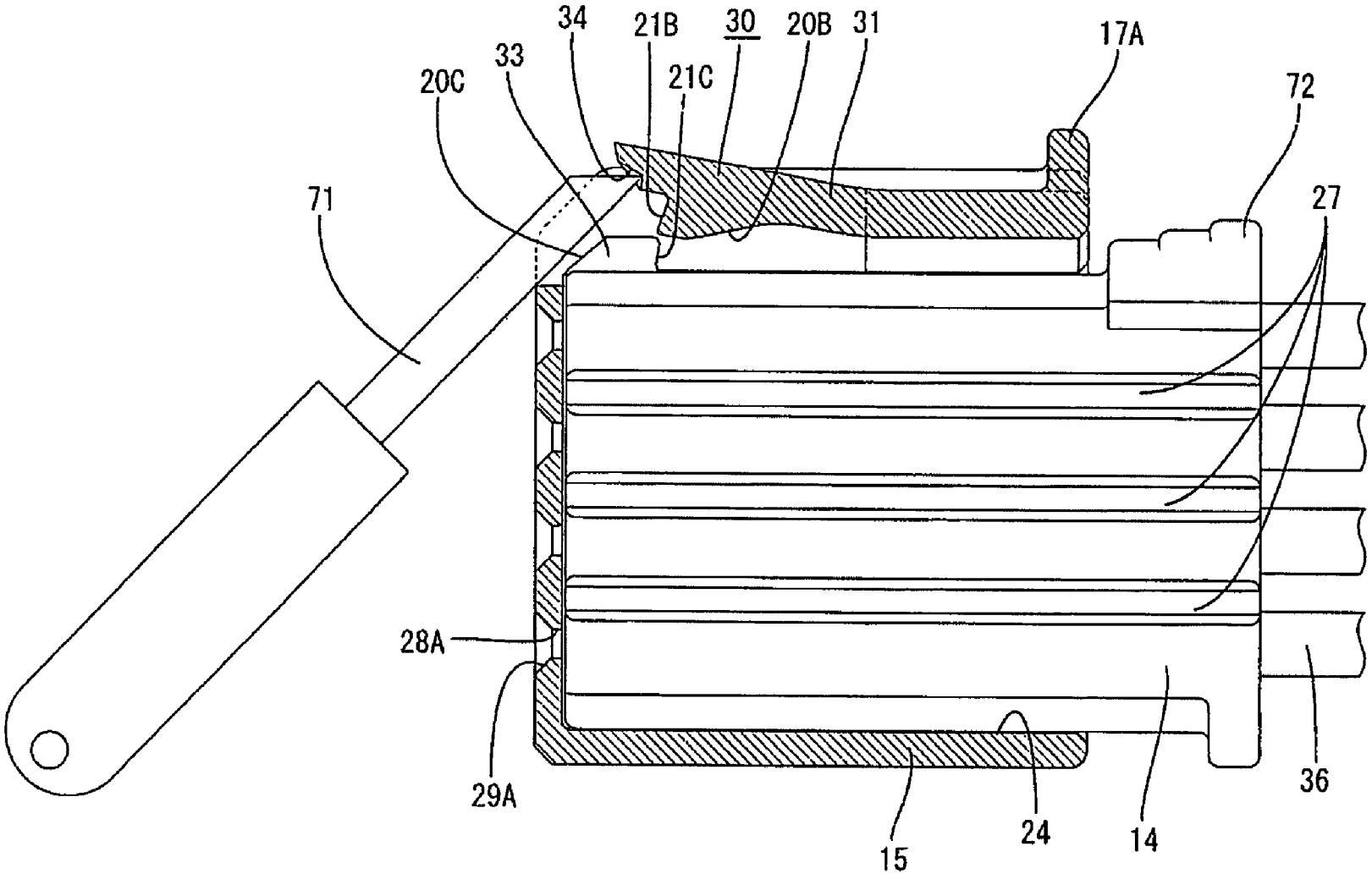
FIG. 30 is a side view in section showing a state where the housing lock and an interacting portion are disengaged by the disengagement jig.

Subsequently, as shown in FIG. 29, the disengagement jig 71 can be inserted into the accommodating chamber 24 through an area of the female frame 15 before the housing lock 30 to bring the leading end of the jig 71 into contact with the disengagement recess 34 of the housing lock 30 from the front. The disengagement recess 34 enables the disengagement jig 71 to be brought securely into contact with the front end of the housing lock 30. As shown in FIG. 30, the disengagement jig 71 deforms the housing lock 30 up and out to disengage the locking projection 32 of the housing lock 30 from the partial locking interacting portion 33 of the auxiliary connector 14. The auxiliary connector 14 then may be pulled back and separated from the female frame 15. The operator can pull the auxiliary connector 14 out by holding the connector side finger placing portions 72 of the auxiliary connector 14 by the fingers. Thus, force easily can be exerted on the auxiliary connector 14.

The retainer 39 of the auxiliary connector 14 then can be swung out about the hinge 75 and displaced from the full locking position to the partial locking position. The locks 40 then are pressed by an unillustrated jig to be disengaged from the female terminal fittings 13, and the female terminal fittings 13 are pulled out backward and separated from the auxiliary connector 14.

As described above, the retainer 39 is moved into the auxiliary connector 14 in the direction intersecting the deforming direction DD of the locks 40. The cavities 35 are arranged substantially in the deforming direction DD of the locks 40. Thus, the locking protrusions 78 of the retainer 39 are arranged substantially at the same positions in the cavities 35 at the respective stages when viewed in the deforming direction DD of the locks 40 and in the arranged direction of the cavities 35 while the retainer 39 is in the retainer accommodating hole 73. As a result, the positions of the female terminal fittings 13 in the cavities 35 at the respective stages to be locked by the retainer 39 can be aligned. Thus, the hinged retainer 39 can be applied to the connector with the cavities 35 arranged in the deforming direction DD of the locks 40.

The female terminal fittings 13 are locked doubly by the retainer 39 in the direction intersecting the deforming direction DD of the locks 40. Thus, the locks 40 prevent displacements of the female terminal fittings 13 along the deforming direction DD of the locks 40 and the retainer 39 prevents displacements of the female terminal fittings 13 along the direction intersecting the deforming direction DD of the locks 40. Displacements along two different directions can be prevented in this way, and the postures of the female terminal fittings 13 can be stabilized.

An attempt could be made to insert the female terminal fitting 13 into the cavity 35 with the retainer 39 inadvertently accommodated in the retainer accommodating hole 73. At this time, the female terminal fitting 13 could be damaged by contact with the retainer 30 if the retainer 39 is constructed not to be displaced by the female terminal fitting 13. However, the retainer 39 of the subject invention has the push-out inclined surface 81 aligned for sliding contact with the female terminal fitting 13. Thus, forces exerted by the female terminal fitting 13 on the push-out inclined surface 81 will push the retainer 39 out of the cavity 35. As a result, the retainer 39 will not damage the female terminal fitting 13.

The tabs 10 are formed by being cut at the opposite sides, and the cut surfaces are not necessarily smooth because a large force is applied for the cutting operation. Thus, the connection stability of the tabs 10 and the resilient contact pieces 86 may be reduced if the cut surfaces are brought into contact with the resilient contact pieces 86. Accordingly, the plate surfaces facing in the thickness direction of the tabs 10 are brought into contact with the resilient contact pieces 86 to make electrical connection between the tabs 10 and the resilient contact pieces 86 more secure.

Connector side finger placing portions 72 are provided on the auxiliary connectors 14. Thus, the operator can hold the connector side finger placing portions 72 by the fingers to separate the auxiliary connector 14 from the female frame 15 to improve the efficiency of the separating operation of the auxiliary connector 14.

The connector side finger placing portions 72 are deviated from the interacting portions 33 in the direction intersecting the inserting direction ID of the auxiliary connectors 14 into the accommodating chambers 24. Thus, a mold to form the interacting portions 33 can be removed backward with respect to the inserting direction ID of the auxiliary connectors 14. A complex sliding mold is unnecessary and production cost can be reduced.

Deviation of the connector side finger placing portions 72 from the interacting portions 33 in the direction intersecting the inserting direction ID of the auxiliary connectors 14 into the accommodating chambers 24 could enlarge the auxiliary connectors 14 in the direction intersecting the inserting direction ID. However, the connector side finger placing portions 72 are behind the partition walls 25 when the auxiliary connectors 14 are in the accommodating chambers 24. Areas behind the partition walls 25 conventionally have been dead spaces. Thus, the disposition of the connector side finger placing portions 72 in these areas avoids enlarging the divided connector in directions intersecting the inserting direction ID of the auxiliary connectors 14.

The invention is not limited to the above described and illustrated embodiment. For example, the following embodiments are also embraced by the technical scope of the present invention as defined by the claims.

Female terminal fittings 13 with the connecting tubes 38 are described in the foregoing embodiment. However, male terminal fittings with tubular portions are within the scope of the invention.

A divided connector to be accommodated into the female frame 15 is described in the foregoing embodiment. However, the invention can be applied to an ordinary connector in which two housings are connected.

Connector side finger placing portions 72 are formed at the positions deviated from the interacting portions 33 in width direction WD in the foregoing embodiment, but they may be formed behind the interacting portions 33 if a sliding mold is used to form the auxiliary connectors 14. The hinge 75 extends vertically in the foregoing embodiment, but may extend in any direction provided that the hinge 75 is on one of the side surfaces facing in the transverse direction of the auxiliary connectors 14.

What is claimed is:

1. A connector, comprising a housing formed with cavities for receiving terminal fittings, resiliently deformable locks formed in the cavities for engaging the terminal fittings, the locks all being deformable along a deforming direction, the cavities being arranged substantially in the deforming direction of the locks;

a retainer accommodating hole extending into a side surface of the housing along a direction intersecting the deforming direction of the locks and having a depth to communicate with the cavities; and a retainer configured for accommodation into the retainer accommodating hole substantially along the direction intersecting the deforming direction of the locks and including locking protrusions engageable with the terminal fittings when the retainer is accommodated in the retainer accommodating hole, wherein the retainer is unitary with the housing and is movable relative to the housing via at least one hinge near an opening edge of the retainer accommodating hole, the hinge being aligned substantially parallel to the deforming direction of the locks.

2. The connector of claim 1, wherein each terminal fitting has a tube with an engageable portion for engaging the locking protrusion of the retainer, and each of said locking protrusions of the retainer is engaged with the engageable portion in the direction intersecting the deforming direction of the lock.

3. The connector of claim 1, wherein an inclined surface is formed on an inner side surface of the retainer and is configured for sliding contact with the terminal fitting for pushing the retainer out of the cavity when the terminal fitting is inserted into the cavity with the retainer in the retainer accommodating hole.

4. A connector assembly comprising the connector of claim 1 and a mating housing connectable therewith, wherein at least one lock provided at a side wall of the mating housing and located at an outer side in a properly connected state of the housings, the lock being deformable out in a thickness direction of the side wall, and at least one interlocking portion formed at the housing and engageable with the lock to hold the housings together.

5. The connector of claim 1, wherein a frame formed with a plurality of accommodating chambers for receiving the connector, the frame being connectable with a mating connector with the connector accommodated in the frame.

6. The connector of claim 5, wherein busbars having tabs are arranged in the thickness direction of the busbars in the mating connector, the accommodating chambers of the frame being arranged in a direction intersecting the thickness direction of the busbars with the frame and the mating connector properly connected.

7. A connector, comprising:

a plurality of housings formed with cavities for receiving terminal fittings, resilient contact pieces being formed in tubes of the terminal fittings to be accommodated in the connector, resilient deformable locks formed in the cavities for engaging the terminal fittings, the cavities being arranged substantially in a deforming direction of the locks;

a frame formed with a plurality of accommodating chambers for receiving the housings, the frame being connectable with a mating connector when the housings are accommodated in the frame;

busbars having tabs arranged in the mating connector, the accommodating chambers of the frame being arranged in a direction intersecting a thickness direction of the busbar when the frame and the mating connector are properly connected, the resilient contact pieces facing each other in a thickness direction of the tabs and being configured and disposed for touching plate surfaces of the tabs formed by cutting opposite sides thereof;

a retainer accommodating hole extending into a side surface of the housing along a direction intersecting the deforming direction of the locks and having a depth to communicate with the cavities; and a retainer configured for accommodation into the retainer accommodating hole and including locking protrusions engageable with the terminal fittings when the retainer is accommodated in the retainer accommodating hole.

8. A connector, comprising:

a housing formed with cavities for receiving terminal fittings, resiliently deformable locks formed in the cavities for engaging the terminal fittings, the cavities being arranged substantially in a deforming direction of the locks;

a frame formed with at least one accommodating chamber for receiving the connector, the frame being connectable with a mating connector with the connector accommodated in the frame;

a retainer accommodating hole extending into a side surface of the housing along a direction intersecting the deforming direction of the locks and having a depth to communicate with the cavities;

a retainer configured for accommodation into the retainer accommodating hole and including locking protrusions engageable with the terminal fittings when the retainer is accommodated in the retainer accommodating hole; and wherein an interacting portion is formed at the front end of the connector with respect to an inserting direction of the connector into the accommodating chamber, the interacting portion projecting out in the deforming direction of the lock and being engageable with a housing lock formed on a surface of the frame facing in the deforming direction of the locks.

9. The connector of claim 8, wherein at least one finger placing portion is formed near a rear end of the side surface of the connector where the interacting portion is formed and at a position deviated from the interacting portion in a direction intersecting the inserting direction of the connector into the accommodating chamber and the finger placing portion rearward of a partition wall partitioning the accommodating chambers with respect to the inserting direction of the connector into the accommodating chamber when the connector is inserted properly in the accommodating chamber.

* * * * *